US007622004B2

(12) United States Patent
Kawatake et al.

(10) Patent No.: US 7,622,004 B2
(45) Date of Patent: Nov. 24, 2009

(54) SLIT DIE, AND METHOD AND DEVICE FOR PRODUCING BASE MATERIAL WITH COATING FILM

(75) Inventors: Hiroshi Kawatake, Otsu (JP); Yoshiyuki Kitamura, Otsu (JP)

(73) Assignee: Toray Industries, Inc., Tokyo (JP)

( * ) Notice: Subject to any disclaimer, the term of this patent is extended or adjusted under 35 U.S.C. 154(b) by 672 days.

(21) Appl. No.: 10/547,534

(22) PCT Filed: Mar. 2, 2004

(86) PCT No.: PCT/JP2004/002537

§ 371 (c)(1),
(2), (4) Date: Aug. 31, 2005

(87) PCT Pub. No.: WO2004/078360

PCT Pub. Date: Sep. 16, 2004

(65) Prior Publication Data

US 2006/0096528 A1 May 11, 2006

(30) Foreign Application Priority Data

Mar. 3, 2003 (JP) ..... 2003-055427

(51) Int. Cl.
*B05C 11/00* (2006.01)

(52) U.S. Cl. ..... 118/679; 118/410; 118/687; 425/141; 425/461; 427/286

(58) Field of Classification Search ..... 118/410, 118/679, 682, 687, 699, 703–704; 425/141, 425/461; 427/286, 356, 427.3, 427.2
See application file for complete search history.

(56) References Cited

U.S. PATENT DOCUMENTS 3,813,204 A * 5/1974 Gregory, Robert B. ..... 425/466
4,990,079 A * 2/1991 Lorenz ..... 425/141

(Continued)

FOREIGN PATENT DOCUMENTS

JP 58-058174 4/1983

(Continued)

OTHER PUBLICATIONS

International Search Report dated Jun. 29, 2004, international application No. PCT/JP2004/002537.

*Primary Examiner*—Brenda A Lamb
(74) *Attorney, Agent, or Firm*—RatnerPrestia

(57) ABSTRACT

A slit die has a combined, opposing pair of lips. Between the lips, the die has a lip gap and a coating liquid discharge opening formed at the lower end of the lip gap. At least one of the lips is constituted of two blocks that are vertically layered over each other and relatively movable in the direction perpendicular to the length direction of the discharge opening. The slit die further has a block-engaging element for engaging the blocks together in such a way that relative positions of the blocks are adjustable, a block-fastening element for fastening the blocks together after their relative positions are adjusted, a positioning element attached to outer surfaces of the blocks, on the side opposite the discharge opening side, and defining the positions to which the blocks are relatively moved, and a fixing element for fixing the positioning element to the blocks.

22 Claims, 11 Drawing Sheets

U.S. PATENT DOCUMENTS 6,139,639 A * 10/2000 Kitamura et al. ..... 118/680

FOREIGN PATENT DOCUMENTS

| | | |
|---|---|---|
| JP | 6-339656 | 12/1994 |
| JP | 8-229482 | 9/1996 |
| JP | 10-146556 | 6/1998 |
| JP | 10-151395 | 6/1998 |
| JP | 10-264229 | 10/1998 |
| JP | 11-197574 A | 7/1999 |
| JP | 11-347474 | 12/1999 |
| JP | 2001-046949 | 2/2001 |
| JP | 2001-191004 | 7/2001 |
| JP | 2001-310147 | 11/2001 |
| JP | 2002-113411 | 4/2002 |

* cited by examiner

Fig. 11 <Prior Art>
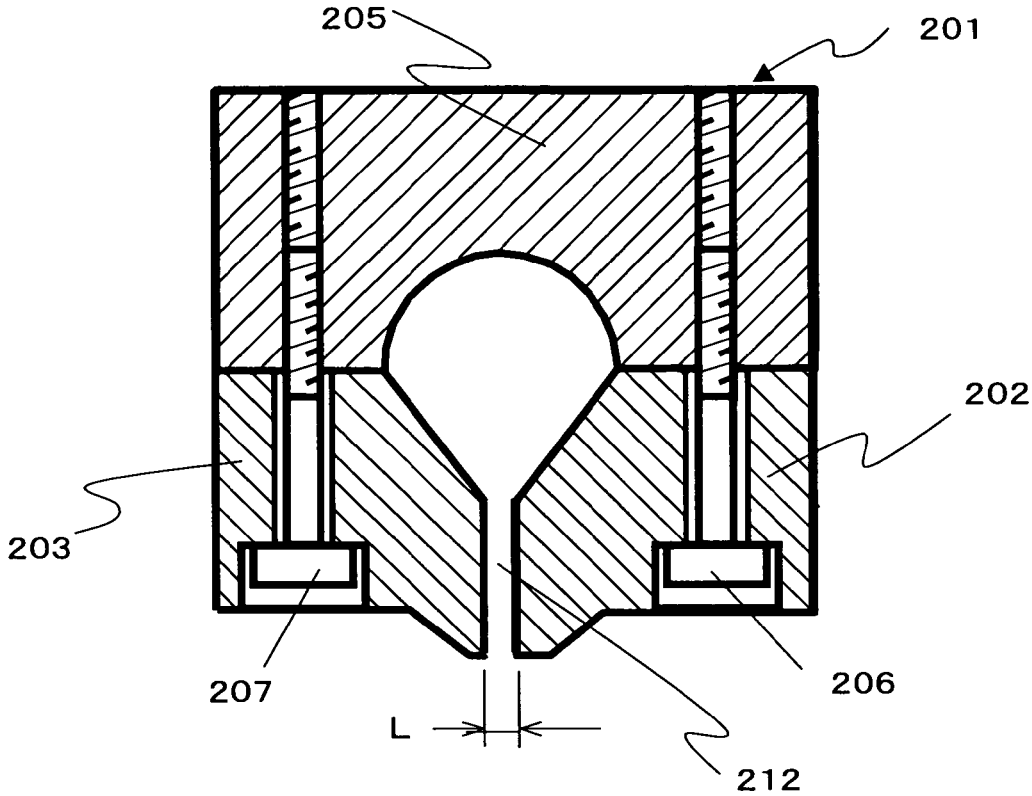
Fig. 12 <Prior Art>
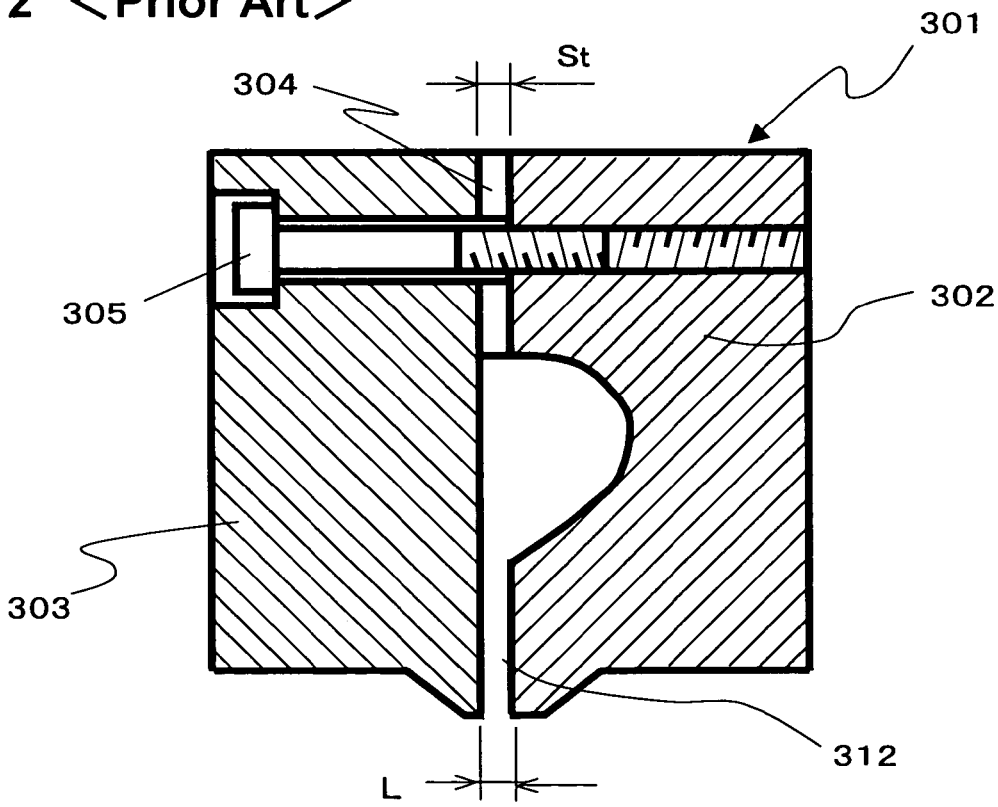

Fig. 13 <Prior Art>
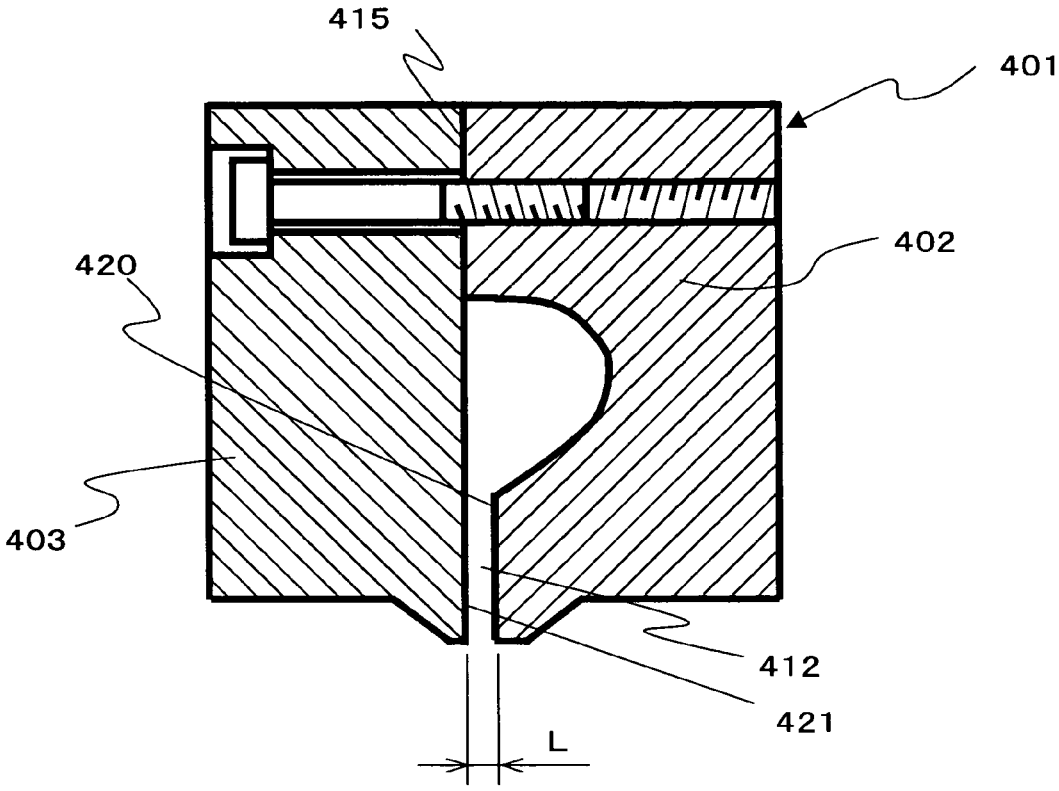

SLIT DIE, AND METHOD AND DEVICE FOR PRODUCING BASE MATERIAL WITH COATING FILM

This is a U.S. National Phase Application of PCT/JP2004/002537 filed Mar. 2, 2004.

TECHNICAL FIELD

The present invention relates to a slit die used for forming a coating film on a surface of a substrate. The present invention also relates to a method and apparatus for producing a substrate having a coating film, which comprises coating a surface of the substrate with a coating liquid by using a slit die of the present invention.

A shape of a substrate to be formed a coating film thereon used in the invention can be either a unit or leaf type sheet having a predetermined length or a long type sheet having a continuous length. A typical example of the shape of the unit type is a glass substrate. A substrate having the shape of the unit type produced by the invention can be used, for example, as a color filter for a color liquid crystal display, an array substrate for TFT, a back plate or front plate for a plasma display, an optical filter, printed board, integrated circuit or semiconductor. A substrate having the shape of the long type produced by the invention can be used, for example, as a film, metallic sheet, metallic foil or paper.

BACKGROUND ART

A slit die is also called a spinneret, die, slot-die or dies. A slit die is used to discharge a coating liquid from a slit-like discharge opening formed toward outside in a lip gap formed between a pair of lips facing each other, to form a coating film on a surface of a substrate facing the discharge opening with a clearance formed between the discharge opening and the substrate. Such slit dies are widely used. When a coating film is formed on a substrate by a slit die, the slit die and the substrate are moved relatively to each other.

As an example, a color filter having a fine lattice pattern of three primary colors formed on a glass substrate is described below. A color filter is produced by coating a glass substrate with coating liquids of black, red, blue and green one after another. The color filter production process may include steps of forming a coating film of photoresist, then patterning by photolithography, and forming poles for forming the space of the liquid crystal to be injected between a color filter and an array substrate, and may also include a step of forming an overcoating film for reducing the ruggedness of the surface.

For this kind of film forming process, spinners have been popularly used for such reasons that the viscosity of the coating liquids used is less than tens of mPa·s and that uniform films can be easily formed. However, recently it is desired to reduce consumption of expensive coating liquids, and it is difficult to enlarge the equipment in response to the increasing use of larger substrates to be coated. So, die coaters using slit dies are being used to substitute the spinners.

One of the important functions required for the slit die is to form a uniformly thick coating film. Especially the slit dies used for producing members for displays such as color filters for color liquid crystal displays and back plates and the like for plasma displays are required to use longer components in response to the yearly expanding screens of displays, and the requirement for the uniformity in the thickness of a coating film over a wide coating area becomes severe. Recently, it is required to achieve a coating thickness accuracy as very severe as 3% or less as the maximum deviation from the mean thickness of the coating film.

To meet this requirement, it is necessary that when a die is assembled, the lip gap usually set at 0.05 mm to 0.7 mm is uniformly formed with a deviation in the order of sub-microns. However, publicly known conventional slit dies cannot achieve a lip gap accuracy in the order of sub-microns owing to their structures, and the above-mentioned coating thickness accuracy could not have been achieved.

The problems of the conventional slit dies are concretely explained below. FIGS. 11, 12 and 13 show the transverse sectional views of respectively different publicly known slit dies 201, 301 and 401.

In FIG. 11, the slit die 201 comprises a die hopper 205, a right lip 202 and a left lip 203. The right lip 202 and the left lip 203 are positioned to face each other with a lip gap 212 formed between them. The top face of the right lip 202 and the top face of the left lip 203 respectively contact the bottom face of the die hopper 205, and are respectively attached to the die hopper 205 for integration by means of bolts 206 and 207.

The lip gap 212 has a lip gap width L. This slit die 201 is disclosed in JP 10-264229 A. The slit die 201 with this constitution needs such complicated assembling work in which both the lips 202 and 203 must be positioned against the die hopper 205 while the lip gap width L is measured in the longitudinal direction of the lip gap 212 (in the direction perpendicular to the paper surface). This assembling work does not practically allow a lip gap accuracy in the order of sub-microns to be achieved.

In FIG. 12, the slit die 301 comprises a right lip 302, a left lip 303 and a shim 304. Both the lips 302 and 303 are combined for integration by a bolt 305 with the shim 304 kept between them. A lip gap 312 is formed by the thickness St of the shim 304.

The lip gap 312 has a lip gap width L. This slit die 301 is disclosed in JP 2001-46949 A or JP 2001-191004 A. In the slit die 301 with this constitution, the lip gap width L of the lip gap 312 is equal to the thickness St of the shim 304, irrespectively of the assembling method. Therefore, to achieve a lip gap accuracy in the order of sub-microns, the thin shim 304 having a thickness St of about 0.05 to about 0.7 mm is required to have a thickness accuracy in the order of sub-microns.

However, in general, the shim 304 formed with a plate produced from a rolled steel plate has an in-plane thickness irregularity as large as several microns due to rolling irregularity. Furthermore, since it is thin, it is difficult to re-machine it for achieving a higher accuracy. Therefore, either in the case of the slit die 301, a lip gap accuracy in the order of sub-microns cannot be achieved.

In FIG. 13, the slit die 401 comprises a right lip 402 and a left lip 403. Both the lips 402 and 403 have a butt interface 415 at their upper portions. The inner lip face 420 of the right lip 402 is positioned with a position difference distance L kept from the butt interface 415. The inner face 421 of the left lip 403 is in the same plane as that of the butt interface 415 and forms a flat lip. Between the inner lip face 420 of the right lip 402 and the inner face 421 of the left lip 403, a lip gap 412 is formed.

The lip gap 412 has a lip gap width L equal to the position difference distance L. This slit die 401 is disclosed in JP 10-146556 A or JP 10-151395 A. In the slit die 401 with this constitution, the lip gap width L of the lip gap 412 is equal to the position difference distance L established in the lip 402. Therefore, for achieving a lip gap accuracy in the order of sub-microns, it is necessary that the position difference between the butt interface 415 and the inner lip face 420 of the lip 402 is formed at a high finishing accuracy in the order of sub-microns.

However, it is difficult to finish a long and large part with a large area like a lip at an accuracy in the order of sub-microns by means of machining using a publicly known grinder, etc. or manual lapping. Therefore, even in the slit die 401, a lip gap accuracy in the order of sub-microns cannot be achieved.

On the other hand, as a die coater using any of these slit dies, known is a die coater comprises a table capable of reciprocating and a coating head (slit die) having a downward discharge opening. In this die coater, a glass substrate is sucked and held on the table, and subsequently, the glass substrate is moved together with the table right under the coating head, when a coating liquid is discharged from the discharge opening of the coating head, to continuously form a coating film of the coating liquid on the glass substrate. This die coater is disclosed in JP 6-339656 A.

In this die coater, since a substrate is coated each by each, the coating methods at the coating start portion and the coating end portion of each substrate are important for enhancing the thickness accuracy of the coating film on the entire substrate. For the coating start portion, available is a method of controlling the relation between the action of the coating liquid feed pump and the action of the substrate. This method is disclosed in JP 8-229482 A.

In another method, preliminary coating from a die to a roll is performed to form bead of the coating liquid between the die and the roll, and the die is moved together with the bead toward the substrate, to start regular coating on the substrate. This method is disclosed in JP 2001-310147 A.

Furthermore, in a method for preventing the thickness at the coating start portion from becoming large, the clearance between the substrate and the die is controlled in interlock with the discharge of the coating liquid and with the horizontal movement of the die to the substrate. This method is disclosed in JP 2002-113411 A.

Among the above-mentioned coating start methods, the method in which the regular coating on a substrate is started after preliminary coating from a die to a roll has such disadvantages that (i) extra equipment is needed to raise the cost, (ii) extra action is needed to make the tact longer, not allowing productivity enhancement, (iii) a slight amount of the coating liquid remains at the tip of the die discharge opening after preliminary coating on the roll, and since the remaining amount is not constant, the thickness of the coating film at the coating start portion varies and is not stable, and (iv) the preliminary coating increases the amount of the coating liquid not used for the regular coating, to raise the cost.

On the other hand, in the case where a coating method without preliminary coating is used, if a coating liquid using a highly volatile solvent is applied to form a wet thickness of 20 μm or less, as shown in FIG. 16A, several non-coated spots 803 where no coating film 802 is formed can occur in the width direction of the substrate B at the coating start portion (head portion) 801. For this defect, the following causes can be considered: (i) the area at and near the discharge opening of the die is cleaned before coating, to keep the coating start portion 801 always in the same state, and in this case, the coating liquid inside the die near the discharge opening is brought away to form voids in the die, or (ii) within the short time after cleaning of the area at and near the discharge opening of the die till coating, it can happen that the solvent of the coating liquid existing in the area at and near the discharge opening is evaporated to form voids in the die near the discharge opening depending on the evaporated amount, and that as a result, the voids not filled with the coating liquid exist in the die and are transferred as they are onto the coating start portion 801 of the substrate B as the non-coated spots 803.

This phenomenon is very unlikely to occur if the wet coating thickness is more than 20 μm. The reason is considered to be that since the rate of the voids to the discharged amount of the coating liquid is small, the voids, even if formed, do not affect the coating state. On the contrary, in the case where preliminary coating is performed, since the voids near the discharge opening are extruded in the stage of preliminary coating, voids do not exist in the die when regular coating is performed. So, the disadvantage that non-coated spots 803 are formed at the coating start portion 801 does not occur.

An object of the invention is to solve the problems of the prior art. The object of the invention is to provide a slit die that allows a lip gap accuracy in the order of sub-microns to be easily achieved. The slit die of the invention allows a uniform coating film to be formed with a very high coating thickness accuracy of 3% or less even if no special adjustment is performed after the die has been assembled.

Another object of the invention is to provide a method and apparatus for producing a substrate with coating films using the slit die.

The substrate with coating films produced by the invention can be preferably used as a member for a color liquid crystal display, or as a member for a plasma display.

The invention allows a coating film with a uniform thickness to be easily formed over the entire surface of a substrate without performing preliminary coating irrespectively of the coating liquid used and irrespectively of the coating thickness. The invention allows the shortening of tact time and the decrease in the amount of wasted coating liquid and allows the production cost to be reduced in the production of a substrate with coating films.

DISCLOSURE OF THE INVENTION

A slit die of the invention comprises a first lip and a second lip, wherein said first lip and said second lip are integrated by a lip fastening element in a state that an inner face of said first lip and an inner face of said second lip are faced each other and partial portions of the inner faces facing each other are positioned with a gap to form a liquid feed passage and a lip gap extending in the longitudinal direction of said lips; the lower end of said lip gap forms a discharge opening toward outside; both the ends in the longitudinal direction of said lip gap are closed from outside; and the top end of said lip gap communicates with said liquid feed passage, characterized in that (a) said first lip comprises a first block and a second block, (b) a block engaging element is provided for keeping said first block and said second block engaged with each other in such a manner that the relative position between said first block and said second block can be adjusted in the direction perpendicular to the face forming said lip gap, of said first lip, (c) a block fastening element is provided for fastening and integrating said first block and said second block after said relative position has been adjusted, (d) a positioning element is provided to be engaged with the outer face of said first block and the outer face of said second block respectively on the side opposite to said inner face of said first lip, to decide said relative position between said first block and said second block, (e) a positioning element fixing element is provided for fixing said positioning element to said first lip, and (f) said positioning element and said positioning element fixing element allow the gap width distribution of said lip gap in the longitudinal direction to be adjusted.

In the slit die of the invention, it is preferred that said positioning element is provided at plural positions with an interval kept between them in the longitudinal direction of said lips.

In the slit die of the invention, it is preferred that said positioning element is a positioning block that has a position deciding face to be kept in contact with at least either the outer face of said first block or the outer face of said second block, and, in the case where there is a region that is not kept in contact with the other outer face, the positioning block has a position decision assisting means to be engaged with said region and said outer face.

In the slit die of the invention, it is preferred that the maximum height Ry of the surface roughness of said position deciding face of said positioning block is from 0.1 S to 1.0 S.

In the slit die of the invention, it is preferred that the thicknesses of said first block and said second block in the direction perpendicular to the face forming said lip gap are respectively 30 mm or more; the sectional form of said positioning block in the direction along said position deciding face is quadrangular; the length of said quadrangle in the longitudinal direction of said lips is from 20 mm to 100 mm, while the length in the direction perpendicular to the longitudinal direction is from 20 mm to 100 mm; and the thickness of said positioning block at the region where at least said position deciding face is positioned is 30% or more of the thickness of said second block.

In the slit die of the invention, it is preferred that said positioning block is provided at plural positions with an interval kept between them in the longitudinal direction of said lips. In the case where plural positioning blocks are provided, it is preferred that the installation intervals are less than 100 mm.

In the slit die of the invention, said second lip may have a structure similar to that of said first lip.

In the slit die of the invention, it is preferred that the inner face of said first block and the inner face of said second lip are positioned in contact with each other or through a shim, and that said lip gap is formed between the inner face of said second block and the inner face of said second lip.

In the slit die of the invention, the inner face of said second lip facing the inner face of said first block and the inner face of said second lip forming said lip gap may be positioned substantially in the same plane.

In the slit die of the invention, the inner face of said first block facing the inner face of said second lip and the inner face of said second block forming said lip gap may be positioned substantially in the same plane.

A method for producing a substrate with coating films of the invention by using a slit die of the invention comprises the steps of feeding a coating liquid into said liquid feed passage of said slit die, discharging said coating liquid from said discharge opening through said lip gap, relatively moving at least either a member to be coated, positioned with a clearance formed against said discharge opening or said slit die, and coating said member to be coated, with said coating liquid discharged from said discharge opening, for forming a coating film of said coating liquid on said member to be coated.

In the method for producing a substrate with coating films of the invention, it is preferred to comprise a first step of discharging said coating liquid with a certain volume Q1 from said discharge opening of said slit die, a second step of standing by for a certain time period Ts after completion of the first step, a third step of moving said discharge opening relatively to said member to be coated, after completion of the second step, for forming a clearance S1 between them, and a fourth step of discharging said coating liquid from said discharge opening after completion of the third step, while moving said member to be coated, relatively to said slit die, for forming a coating film on said member to be coated.

In the method for producing a substrate with coating films of the invention, it is preferred that said certain volume Q1 satisfies the relation of $Q1=\alpha 1\times S1\times Ls\times W$, where Ls is the length of the face including said discharge opening in the coating direction; W is the length of said discharge opening in the longitudinal direction, S1 is said clearance and $\alpha 1$ is a coefficient in a range of $0.05\leqq\alpha 1\leqq 1.0$.

In the method for producing a substrate with coating films of the invention, it is preferred to comprise a first step of moving said discharge opening of said slit die relatively to said member to be coated, kept stationary, for forming a clearance S2 between them, a second step of discharging said coating liquid with a certain volume Q2 from said discharge opening after completion of the first step, a third step of standing by for a certain time period Ts after completion of the second step, and a fourth step of discharging said coating liquid from said discharge opening, after completion of the third step, while moving said member to be coated, relatively to said slit die, for forming a coating film on said member to be coated.

In the method for producing a substrate with coating films of the invention, it is preferred to comprise a first step of moving said discharge opening of said slit die relatively to said member to be coated, kept stationary, for forming a first clearance S3 between them, a second step of discharging said coating liquid with a certain volume Q from said discharge opening after completion of the first step, a third step of standing by for a certain time period Ts after completion of the second step, a fourth step of re-moving said discharge opening of said slit die relatively to said member to be coated, kept stationary, after completion of the third step, for forming a second clearance S4 between them, and a fifth step of discharging said coating liquid from said discharge opening, after completion of the fourth step, while moving said member to be coated, relatively to said slit die, for forming a coating film on said member to be coated.

In the method for producing a substrate with coating films of the invention, it is preferred that the size of said first clearance S3 is smaller than the size of said second clearance S4.

In the method for producing a substrate with coating films of the invention, it is preferred that said certain volume Q2 satisfies the relation of $Q2=\alpha 2\times S2\times Ls\times W$, where Ls is the length of the face including said discharge opening in the coating direction, W is the length of said discharge opening in the longitudinal direction, S2 is said clearance and $\alpha 2$ is a coefficient in a range from $0.05\leqq\alpha 2\leqq 1.0$.

An apparatus for producing a substrate with coating films of the invention comprises the slit die of the invention, a coating liquid feed means engaged with said liquid feed passage of said slit die, a coating liquid discharge means for discharging the coating liquid fed into said liquid feed passage, from said discharge opening through said lip gap, and a coating film forming means for relatively moving at least either a member to be coated, positioned with a clearance formed against said discharge opening, or said slit die, to coat said member to be coated, with said coating liquid discharged from said discharge opening, for forming a coating film of said coating liquid on said member to be coated.

In the apparatus for producing a substrate with coating films of the invention, it is preferred to comprise a means for discharging a certain amount of said coating liquid from said discharge opening of said slit die, a means for letting a certain standby time period to elapse after discharging said certain amount of said coating liquid, and a coating film forming means for relatively moving at least either a member to be coated, positioned with a clearance formed against said discharge opening, or said slit die after lapse of said standby time period, while coating said member to be coated, with said coating liquid discharged from said discharge opening, to form a coating film of said coating liquid on said member to be coated.

BRIEF DESCRIPTION OF THE DRAWINGS

FIG. 11 is a transverse sectional view of a conventional slit die.

FIG. 12 is a transverse sectional view of another conventional slit die.

FIG. 13 is a transverse sectional view of a still another conventional slit die.

THE BEST MODES FOR CARRYING OUT THE INVENTION

Preferred modes for carrying out the invention are explained below in reference to the drawings.

Figure 1:
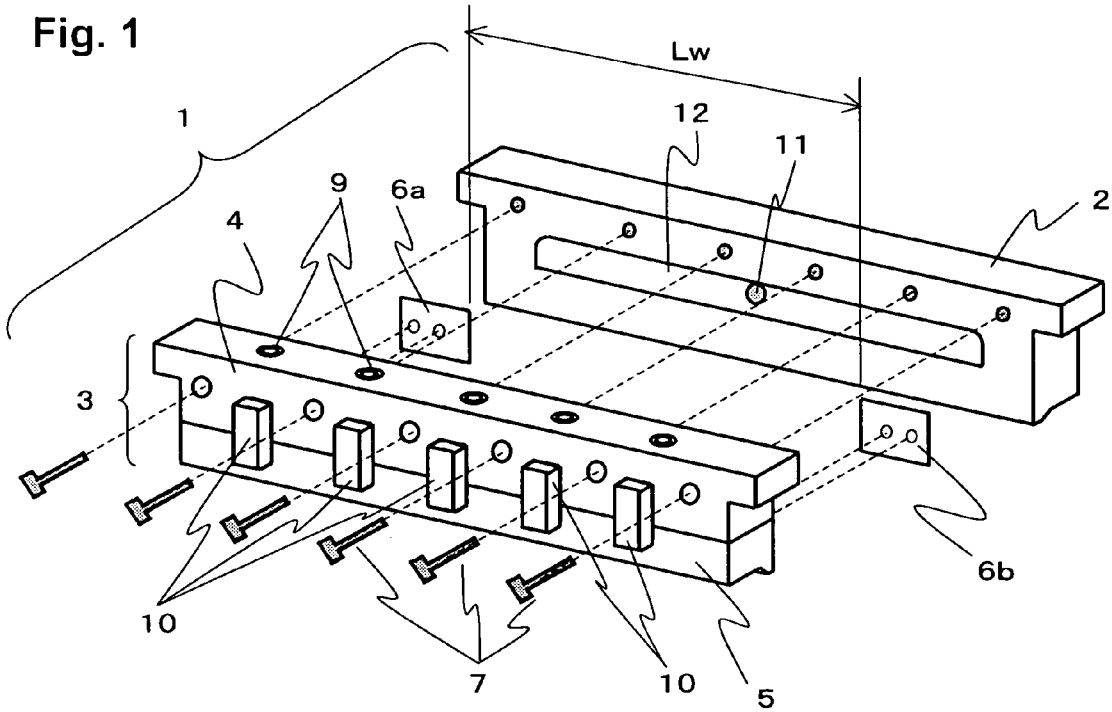
FIG. 1 is a perspective view showing a state where the respective parts of a slit die of the invention as an embodiment are disassembled.
Figure 2:
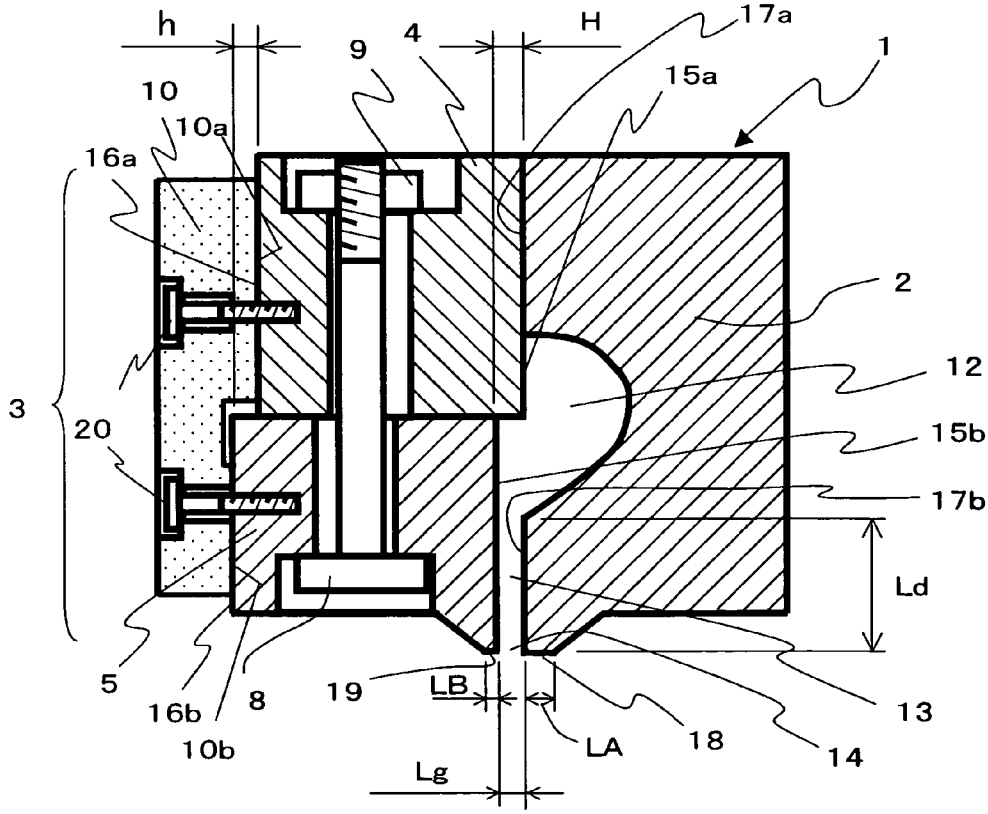
FIG. 2 is a transverse sectional view of the slit die of FIG. 1.

In FIGS. 1 and 2, a slit die 1 of the invention comprises a first lip 3 and a second lip 2. The first lip 3 and the second lip 2 are integrated by a lip fastening element with inner faces 15*a* and 15*b* of the first lip 3 and inner faces 17*a* and 17*b* of the second lip 2 facing each other, in such a manner that they can be separated. In this embodiment, six assembling bolts 7 disposed with intervals kept between them are used as the lip fastening element as shown in FIG. 1.

The inner faces 15*a* and 15*b* and the inner faces 17*a* and 17*b* facing each other are positioned to be partially apart from each other, to thereby form a liquid feed passage (manifold) 12 and a lip gap 13 extending in the longitudinal direction of the lips 2 and 3. The bottom end of the lip gap 13 forms a discharge opening 14 toward outside. Both side ends of the lip gap 13 in the longitudinal direction are closed from outside by sealing plates 6*a* and 6*b*. The top end of the lip gap 13 communicates with the liquid feed passage (manifold) 12. The liquid feed passage (manifold) 12 has a coating liquid feed port 11 that is connected through a feed pipe (not shown in the drawing) with a coating liquid feed means (not shown in the drawing). The coating liquid fed from the coating liquid feed means flows from the coating liquid feed port 11 into the manifold 12 that guides the flow of the coating liquid toward both sides with the coating liquid feed port 11 as the center. Then, the coating liquid flows into the lip gap 13 and is discharged from the discharge opening 14.

The first lip 3 comprises a first block 4 and a second block 5. The length of the bottom face of the first block 4 in the longitudinal direction is equal to the length of the top face of the second block 5 in the longitudinal direction. The inner face 17*a* of the second lip 2 and the inner face 15*a* of the first block 4 contact each other. The bottom face of the first block 4 and the top face of the second block 5 contact each other.

The first block 4 and the second block 5 are engaged with each other by a block engaging element capable of adjusting their relative position in the direction perpendicular to the face 15*b* forming the gap 13, of the first lip 3 (the inner face of the second block). In this embodiment, bolts 8 and nuts 9 are used as the block engaging element.

After the relative position between the first block 4 and the is second block 5 has been adjusted, they are fastened and integrated by a block fastening element. In this embodiment, as the block fastening elements, bolts 8 and nuts 9 are used. In this embodiment, the bolts 8 and the nuts 9 function as the block engaging elements as well as the block fastening elements. The block engaging element and the block fastening element can be constituted by respectively different members, so that the respective functions can work separately.

A positioning element for deciding the relative position between the first block 4 and the second block 5 are engaged with an outer face 16*a* of the first block 4 and an outer face 16*b* of the second block 5 respectively on the side opposite to the inner face 15*a* of the first lip 3. In this embodiment, five stepped blocks 10 disposed with intervals kept between them are used as the positioning element. An inner face 10*a* of the upper portion of the stepped block 10 contacts the outer face 16*a* of the first block 4, and an inner face 10*b* of the lower portion of the stepped block 10 contact the outer face 16*b* of the second block 5. The inner face 10*a* and the inner face 10*b* form a position deciding face.

A positioning element fixing element is provided for fixing the positioning element (stepped blocks 10) to the first lip 3 comprising the first block 4 and the second block 5. In this embodiment, as the positioning element (stepped block 10) fixing element, bolts 20 are used. In this embodiment, the inner face 17*a* of the second lip 2 facing the inner face 15*a* of the first block 4 and the inner face 17*b* of the second lip 2 forming the lip gap 13 are positioned in substantially the same plane.

The positioning element (stepped blocks 10) and the positioning element fixing element (bolts 20) are used to adjust the lip gap width Lg of the lip gap 13 for making it uniform in the longitudinal direction of the lip gap 13.

Between the position of the inner face 15*a* of the first block 4 and the position of the inner face 15*b* of the second block 5, there is a position difference with distance H in the direction perpendicular to the respective inner faces. This difference with distance H is called a position difference H, and the size of the position difference H is called a position difference distance H.

Between the position of the inner face 10*a* of the upper portion of the stepped block 10 and the position of the inner faces 10*b* of the lower portion, there is a position difference with distance h in the direction perpendicular to the respective inner faces. The difference with distances h is called a position difference h, and the sizes of the position difference h are called a position difference distance h.

The position difference H with position difference distance H is formed by pressing the five stepped blocks 10 with position differences h to the outer face 16*a* of the first block 4 and the outer face 16*b* of the second block 5.

The number and installation intervals of the stepped blocks 10 are not especially limited, but if the slit die 1 is long, it is preferred to install at least two or more, preferably five or more stepped blocks 10 in the longitudinal direction. It is desirable that the installation intervals are 100 mm or less, for forming uniform position difference distance H in the longitudinal direction of the slit die 1.

If the first lip 3 and the second lip 2 are assembled by means of assembling bolts 7, the lip gap 13 with gap width Lg equal to the position difference distance H between the inner face 15*a* of the first block 4 and the inner face 15*b* of the second block 5 is formed.

The lip gap 13 serves to give a flow resistance to the coating liquid and to discharge the coating liquid from the discharge opening 14 with a uniform distribution. To give a desired flow resistance to the coating liquid in response to various coating conditions, it is preferred that the gap width Lg of the lip gap 13 is from 30 μm to 1,000 μm. A more preferred range is from 50 μm to 600 μm. It is preferred that the length Ld of the lip gap 13 in the direction of discharging the coating liquid is from 3 mm to 100 mm. A more preferred range is from 5 mm to 70 mm.

The length of the discharge opening 14 in the longitudinal direction as the discharge width of the coating liquid is decided by the installation interval Lw of the two sealing plates 6*a* and 6*b*. The material and form of the sealing plates 6*a* and 6*b* are not especially limited, if they are not affected by the solvent and other ingredients contained in the coating liquid and allow sealing to prevent the leak of the coating liquid. Metallic plates such as stainless steel plates with a thickness equal to or slightly smaller than the gap width Lg of the lip gap 13 or on the contrary, elastic members, for example, resin sheets such as polyethylene terephthalate sheets with a thickness slightly larger than the gap width Lg can be suitably used.

A preferred example of forming the position difference H in the first lip 3 of this embodiment is explained below in reference to FIGS. 3A, 3B and 3C.

Figure 3A:
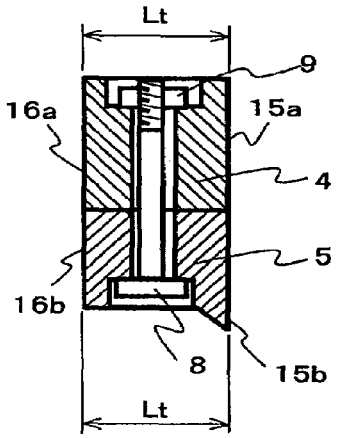
FIG. 3A, FIG. 3B and FIG. 3C are transverse sectional views for explaining the assembling procedure of a first block and a second block constituting a first lip, and a positioning block in the slit die of FIG. 1.
Figure 3B:
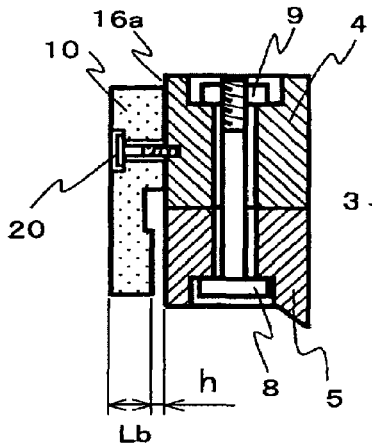

As shown in FIG. 3A, the first block 4 and the second block 5 are overlaid with one on the other and temporarily set by means of the bolts 8 and the nuts 9, and in this state, they are machined simultaneously to ensure that their thicknesses Lt in the direction perpendicular to the inner faces 15*a* and 15*b* become equal to each other. In this state, as shown in FIG. 3B, all the stepped blocks 10 are attached to the outer face 16*a* of the first block 4 by means of the bolts 20.

Figure 3C:
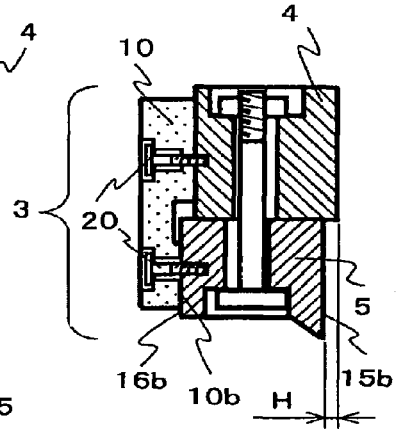

Then, as shown in FIG. 3C, the second block 5 is slid in the direction perpendicular to the inner face 15*b*, causing the outer face 16*b* of the second block 5 to contact the inner faces 10*b* of the lower portions of the stepped blocks 10. Then, the stepped blocks 10 are fixed to the second block 5 using the bolts 20, to complete the adjustment of the relative position between the first block 4 and the second block 5.

As a result, in the first lip 3 comprising the first block 4 and the second block 5, the position difference H with position difference distance H equal to the position difference distances h of the stepped blocks 10 is uniformly formed between the blocks 4 and 5 in the longitudinal direction.

In this constitution, if the position difference distance h of each stepped block 10 is slightly changed, the position difference distance H between the first block 4 and the second block 5 can be finely adjusted, and as a result, the gap width Lg of the lip gap 13 equal to the position difference distance H can be freely finely adjusted in the longitudinal direction of the lip gap 13. With this fine adjustment, the lip gap 13 with gap width Lg deviating in the order of sub-microns can be easily formed merely by combining the first lip 3 and the second lip 2.

As a method for slightly changing the position difference distance h of each stepped block 10, a publicly known working method such as lapping or grinding can be used. In this case, for accurately measuring the slight changes of the position difference distances h, it is preferred that the faces in contact with the first block 4 and the second block 5, namely, the inner faces 10*a* of the upper portions and the inner faces 10*b* of the lower portions of the stepped blocks 10 have their surface roughness kept in a range from 0.1 S to 1.0 S as the maximum height (Ry) defined in JIS B 0031 (1994).

To facilitate the fine adjustment of the position difference distance H between the first block 4 and the second block 5, it is preferred that the first block 4 and the second block 5 have high rigidity. For this purpose, it is preferred that the thicknesses Lt of the respective blocks are 30 mm or more. In the case where the respective thicknesses Lt are less than 30 mm, the respective blocks 4 and 5 are likely to be warped in the sections free from the stepped blocks 10 in the longitudinal direction, making the fine adjustment of the position difference distance H difficult.

As for the form of the stepped blocks 10, it is preferred that the width of each stepped block corresponding to the longitudinal direction of the slip die 1 is in a range from 20 mm to 100 mm, and that the height in the direction perpendicular to it is in a range from 20 mm to 100 mm. If the form of the stepped blocks 10 is smaller than the lower limits of these ranges, the correction force necessary for the free fine adjustment of the position difference distance H cannot be sufficiently exhibited. On the contrary, if the form is larger than the upper limits of these ranges, it is difficult to finely change the position difference distances h by a working means such as lapping or grinding. The stepped blocks 10 must have the rigidity necessary for the fine adjustment of the position difference distance H. For this purpose, it is preferred that the thickness of each stepped block 10 at the thinnest portion (for example the portion corresponding to the dimension Lb shown in FIG. 3B) corresponds to 30% or more of the thickness Lt of the second block 5.

To easily keep the deviation of the gap width Lg of the lip gap 13 in the order of sub-microns in the longitudinal direction of the slit die 1, it is preferred that the deviation of the position difference distances h among the plural stepped blocks 10 installed in the longitudinal direction is 1 μm or less. More preferred is 0.5 μm or less.

To keep small the adjusted amount of the position difference distance H between the first block 4 and the second block 5, it is preferred that the inner faces 17*a* and 17*b* of the second lip 2, the inner face 15*a* and the outer face 16*a* of the first block 4 and the inner face 15*b* and the outer face 16*b* of the second block 5 are finished to be 5 μm or less in flatness. It is more preferred that the respective faces are finished to be 2 μm or less. The flatness in this case is defined in "Definitions and Indications of Geometric Deviations" of JIS B 0621 (1984).

To enhance the assembling repeatability of the slit die 1, it is preferred that the rigidity of the first lip 3 is the same as that of the second lip 2. For this purpose, it is preferred that the thickness of the second lip 2 is kept equal to the thickness Lt of the first block 4 and the second block 5.

Since the slit die 1 shown in this embodiment has a constitution as described above, a lip gap accuracy in the order of sub-microns can be easily achieved even though the slit die is long, namely, even though the slit die is used to form a coating film with a large area. For this reason, if the slit die 1 is assembled with the stepped blocks 10 fixed to the first lip 3, a coating film with a very high coating thickness accuracy of 3% or less can be formed even without performing any special adjustment.

Especially as a slit die for a coater used for producing a member for a display in need of uniformly formed coating films, such as a color filter for a color liquid crystal display or a back plate for a plasma display, the slit die 1 can be suitably used.

Furthermore, in the case where the coating liquid flowing in the manifold 12 greatly changes in viscosity to impair the thickness uniformity of the coating film due to a factor other than the lip gap distribution, if the position difference distances h of the stepped blocks 10 positioned in the portions where the coating film thickness greatly changes are adjusted, the thickness irregularity of the coating film due to the factor can be improved.

In response to various operation conditions, the position difference distances h of the stepped blocks 10 can be changed to change the gap width Lg of the lip gap 13, or the respective position difference distances h of plural stepped blocks 10 installed in the longitudinal direction can be made different from each other to form a lip gap 13 with a distribution corresponding to a given thickness profile of a coating film.

The positioning elements for positioning the first block 4 and the second block 5 by sliding them relatively to each other are not limited to the stepped blocks 10. Examples of the positioning elements other than the stepped blocks are explained below.

Figure 4:
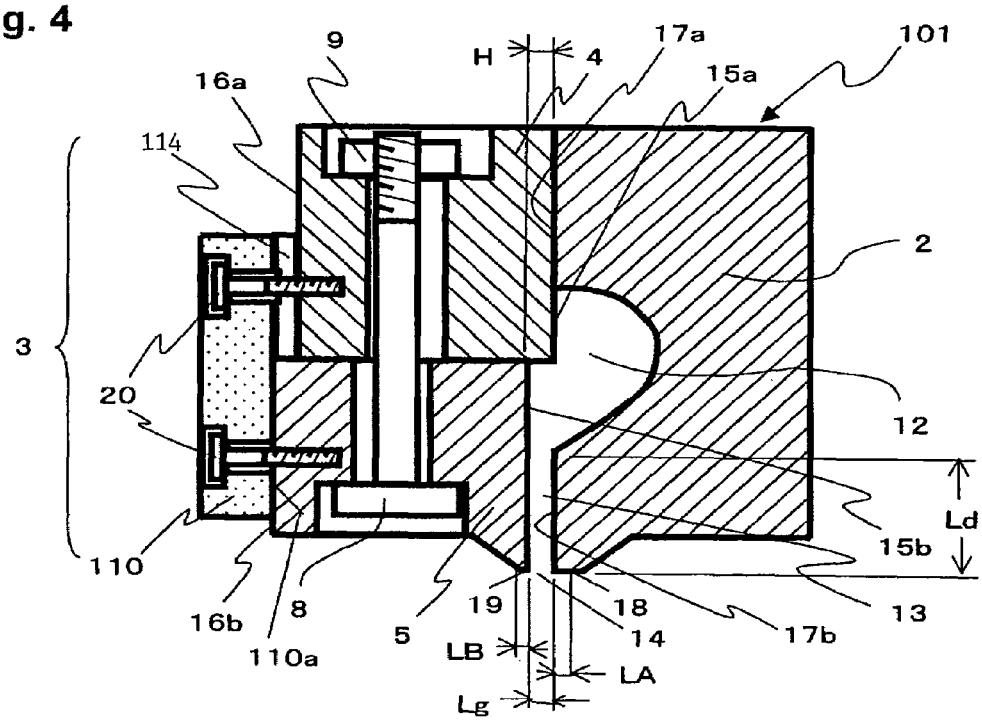
FIG. 4 is a transverse sectional view of the slit die of another embodiment of the invention.

FIG. 4 shows another embodiment of the slit die of the invention. In FIG. 4, as in the embodiment shown in FIG. 2, a slit die 101 comprises a first lip 3, a second lip 2, a first block 4 and a second block 5 constituting the first lip 3, and bolts 8 and nuts 9 for engaging and fastening the first block 4 with and to the second block 5.

As in the embodiment shown in FIG. 2, the slit die 101 has a lip gap 13, a discharge opening 14 and a manifold 12. In the slit die 101, as in the embodiment shown in FIG. 2, the inner face 17*a* of the second lip 2 facing the inner face 15*a* of the first block 4 and the inner face 17*b* of the second lip 2 forming the gap 13 are positioned substantially in the same plane.

The slit die 101 has positioning elements, each comprising a flat block 110 and a shim 114 (position definition assisting means), instead of the stepped blocks 10 in the embodiment shown in FIG. 2. The inner faces 110*a* of the flat blocks 110 respectively have a single flat face. The inner faces 110*a* are kept in contact with the outer face 16*b* of the second block 5.

There is a position difference between the outer face 16*a* of the first block 4 and the outer face 16*b* of the second block 5. The shims 114 intervene in the gaps formed by the position differences between the outer face 16*a* of the first block 4 and the inner faces 110*a* of the flat blocks 110. The shims 114 are fitted in the gaps when the flat blocks 110 and the second block 4 are fixed using the bolts 20 of the flat blocks 110. The thicknesses of the shims 114 are adjusted to be equal to the gap width Lg of the lip gap 13.

The position difference distance H between the first block 4 and the second block 5 can be finely adjusted by finely adjusting the surface roughness values of the inner faces 110*a* of the flat blocks 110 or finely adjusting the thicknesses of the shims 114. With this fine adjustment, the gap width Lg of the lip gap 13 of the slit die 101 can be adjusted uniformly in the longitudinal direction of the lip gap 13 by the positioning elements and the positioning element fixing elements comprising the flat blocks 110, shims 114 and bolts 20.

Figure 5:
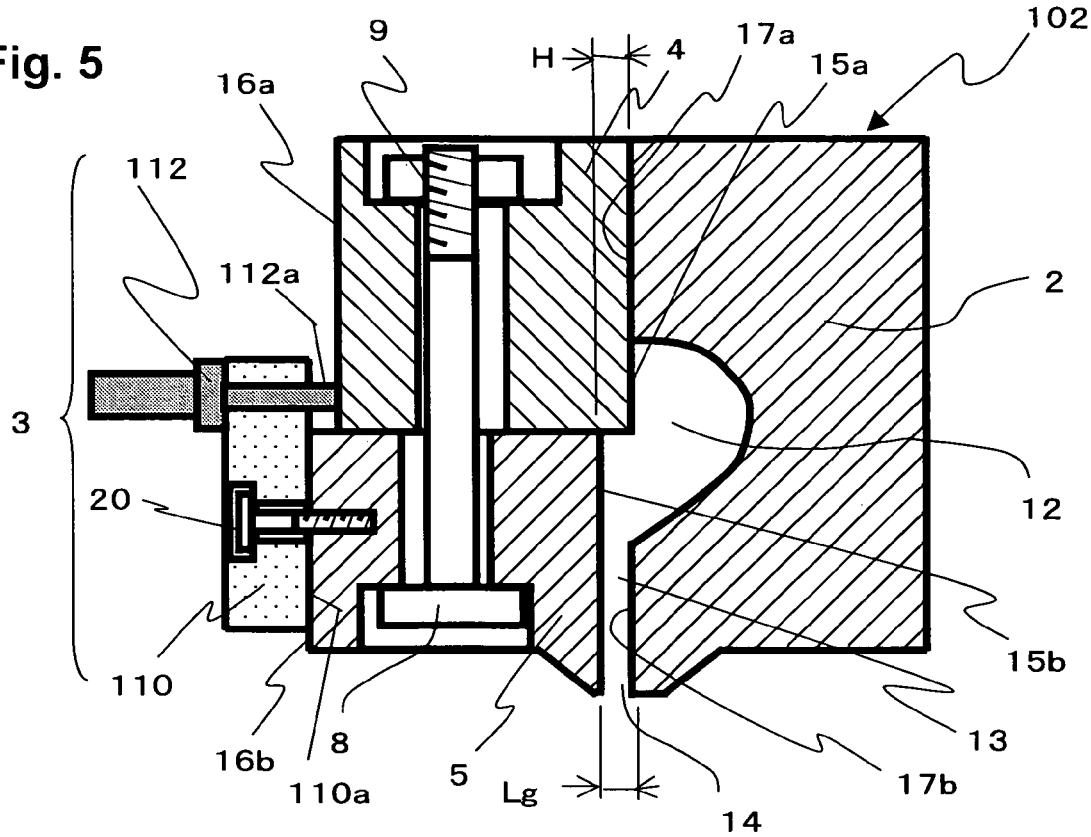
FIG. 5 is a transverse sectional view of the slit die of still another embodiment of the invention.

FIG. 5 shows a further other embodiment of the slit die of the invention. In FIG. 5, as in the embodiment shown in FIG. 2, a slit die 102 comprises a first lip 3, a second lip 2, a first block 4 and a second block 5 constituting the first lip 3, and bolts 8 and nuts 9 used for engaging and fastening the first block 4 with and to the second block 5.

As in the embodiment shown in FIG. 2, the slit die 102 has a lip gap 13, a discharge opening 14 and a manifold 12. In the slit die 102, as in the embodiment shown in FIG. 2, the inner face 17*a* of the second lip 2 facing the inner face 15*a* of the first block 4 and the inner face 17*b* of the second lip 2 forming the lip gap 13 are positioned substantially in the same plane.

In FIG. 5, the slit die 102 has positioning elements, each comprising a flat block 110 and an expansion means 112 (position definition assisting means) instead of the stepped blocks 10 shown in FIG. 2. The inner faces 110*a* of the flat blocks 110 respectively have a single flat face. The inner faces 11*a* are kept in contact with the outer face 16*b* of the second block 5. There is a position difference between the outer face 16*a* of the first block 4 and the outer face 16*b* of the second block 5. The expansion means 112 intervene in the gaps formed by the position differences between the outer face 16*a* of the first block 4 and the inner faces 110*a* of the flat blocks 110. The expansion means 112 are, for example, micrometer heads or linear actuators.

The expansion means 112 are fixed to the tops of the flat blocks 110. Expansion members 112*a* of the expansion means 112 are projected from the inner faces 110*a* of the flat blocks 110 toward the first block 4, and their tips are pressed against the outer face 16*a* of the first block. The projecting lengths of the expansion members 112*a* from the inner faces 110*a* of the flat blocks 110 to the outer face 16*a* of the first block 4 are adjusted to be equal to the gap width Lg of the lip gap 13.

The position difference distance H between the first block 4 and the second block 5 can be finely adjusted by finely adjusting the projecting lengths of the expansion members 112*a* of the expansion means 112. With this fine adjustment, the gap width Lg of the lip gap 13 of the slit die 102 can be adjusted uniformly in the longitudinal direction of the lip gap 13 by the positioning elements and the positioning element fixing elements comprising the flat blocks 110, expansion means 112 and bolts 20.

In the slit die of the invention, the method for measuring the position difference distance H is not especially limited if measurement can be performed at a necessary resolution and accuracy. For example, two linear gauges are pressed against at right angles to a uniform surface such as a precision surface plate and set at zero, and one of them is pressed against at right angles to the inner face 15*a* of the first block 4 while the other linear gauge is pressed against at right angles to the inner face 15*b* of the second block 5. When one of the linear gauges indicates zero, the value indicated by the other linear gauge is read. This method is preferred since measurement can be performed simply at high accuracy.

In the slit die of the invention, the lip gap accuracy is defined as the maximum deviation of the values obtained by measuring the gap width (for example, the gap width Lg in FIG. 2) of the lip gap at many points in the longitudinal direction of the lip gap. With regard to the measuring method, it is preferred that an optical microscope or the like is used to measure the gap width of the discharge opening (for example, the discharge opening 14 in FIG. 2) magnified 450 fold to 2,000 fold, as the gap width of the lip gap.

A further other embodiment of the slit die of the invention is explained below.

Figure 6:
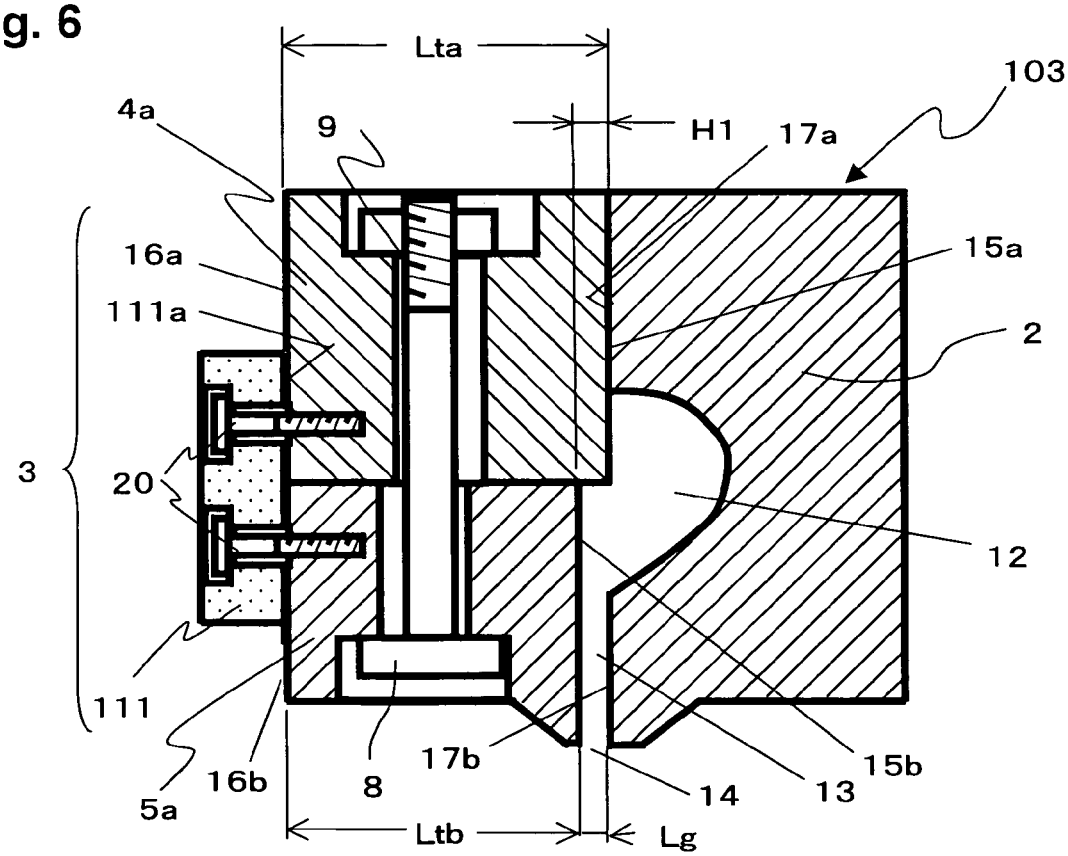
FIG. 6 is a transverse sectional view of the slit die of a further embodiment of the invention.

In the above-mentioned embodiments, for setting position difference H in the second lip 3, the first block 4 and the second block 5 respectively having the same thickness Lt are used. However, the method for establishing the position difference H is not limited to it. FIG. 6 shows another method for establishing the position difference H.

In FIG. 6, as in the embodiment shown in FIG. 2, a slit die 103 of the invention comprises a first lip 3, a second lip 2, a first block 4*a* and a second block 5*a* constituting the first lip 3, and bolts 8 and nuts 9 for engaging and fastening the first block 4*a* with and to the second block 5*a*.

As in the embodiment shown in FIG. 2, the slit die 103 has a lip gap, 13, a discharge opening 14 and a manifold 12. In the slit die 103, as in the embodiment shown in FIG. 2, the inner face 17*a* of the second lip 2 facing the inner face 15*a* of the first block 4*a* and the inner face 17*b* of the second lip 2 forming the lip gap 13 are positioned substantially in the same plane.

However, the first block 4*a* and the second block 5*a* in the slit die 103 are different in the thickness in the direction perpendicular to the inner face 15*b* of the second block 5*a* forming the lip gap 13. In this regard, the slit die 103 is different from the slit dies 1, 101 and 102 shown in FIGS. 2, 4 and 5. In FIG. 6, the first block 4*a* has thickness Lta and the second block 5*a* has thickness Ltb. Owing to the difference between thickness Lta and thickness Ltb, a position difference H1 is formed between the inner face 15*a* of the first block 4*a* and the inner face 15*b* of the second block 5*a*.

Flat blocks 111 as positioning elements are fixed to the outer face 16*a* of the first block 4*a* and the outer face 16*b* of the second block 5*a* by means of bolts 20 provided as fixing elements. The inner faces 111*a* of the flat blocks 111 are kept in contact with the outer face 16*a* of the first block 4*a* and the outer face 16*b* of the second block 5*a*.

If the first lip 3 and the second lip 2 are assembled using assembling bolts 7 (see FIG. 1), the lip gap 13 having gap width Lg equal to the position difference distance H1 between the inner face 15*a* of the first block 4*a* and the inner face 15*b* of the second block 5*a* is formed.

The number of position differences H (H1) forming the lip gap 13 with gap width Lg is one in the above-mentioned embodiments, but the number is not limited to one. Three or more blocks can be overlaid to form two or more position differences in the first lip 3.

In the above-mentioned embodiments, a mode in which the first lip 3 comprises two blocks, namely, the first block 4 (4*a*) and the second block 5 (5*a*) has been explained, but the invention is not limited to this mode. A mode in which the first lip 3 and the second lip 2 respectively comprises vertically stacked plural blocks adjustable in their relative positions can also be used.

The slit die of the invention can also be applied to a slit die for simultaneously forming plural coating films on a member to be coated, namely, to a slit die having two or more lip gaps formed by three or more lips for simultaneous multi-layer coating.

The method for forming the lip gap 13 is not limited to a mode in which the position difference formed between plural blocks is used to form the lip gap.

Figure 7:
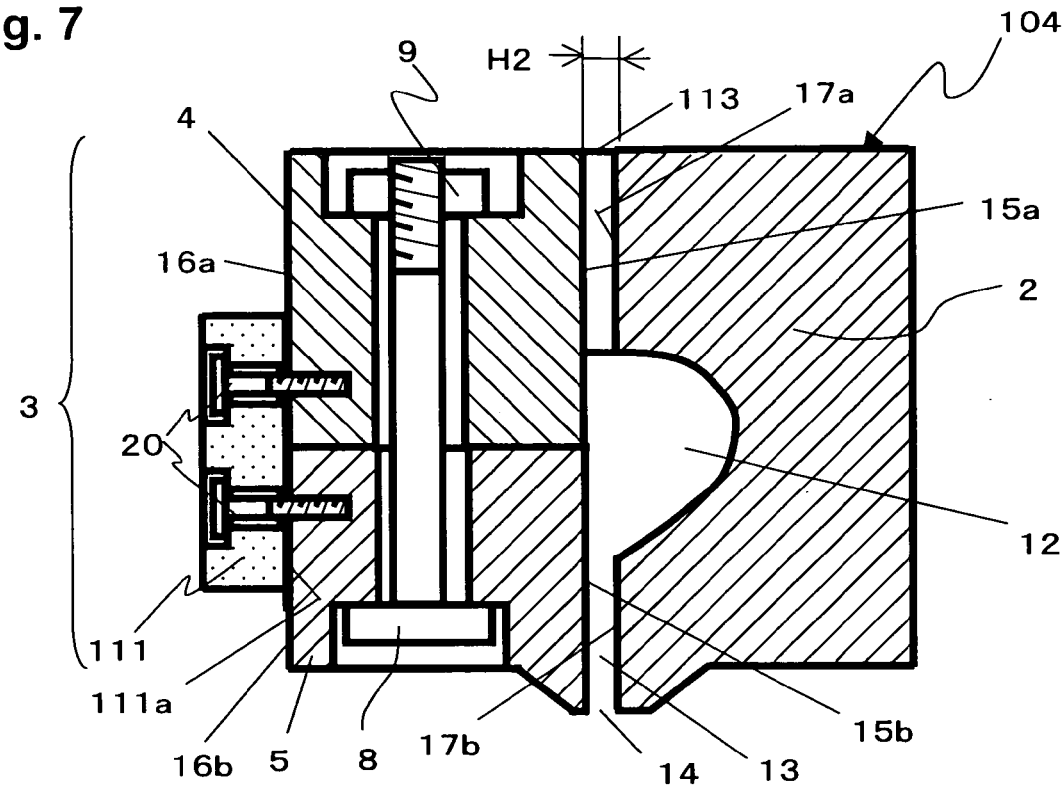
FIG. 7 is a transverse sectional view of the slit die of a still further embodiment of the invention.

FIG. 7 shows another example for forming the position difference. In FIG. 7, as in the embodiment shown in FIG. 2, a slit die 104 of the invention comprises a first lip 3, a second lip 2, a first block 4 and a second block 5 constituting the first lip 3, and bolts 8 and nuts 9 for engaging and fastening the first block 4 with and to the second block 5.

As in the embodiment shown in FIG. 2, the slit die 104 has a lip gap 13, a discharge opening 14 and a manifold 12.

As in the embodiment shown in FIG. 6, the slit die 104 has flat blocks 111 as positioning elements. The inner faces 111*a* of the flat blocks 111 respectively have a single flat face. The inner faces 111*a* are kept in contact with the outer face 16*a* of the first block 4 and the outer face 16*b* of the second block 5.

In the slit die 104, as in the embodiment shown in FIG. 2, the inner face 17*a* of the second lip 2 facing the inner face 15*a* of the first block 4 and the inner face 17*b* of the second lip 2 forming the lip gap 13 are positioned substantially in the same plane.

However, in the slit die 104, there is no position difference between the inner face 15*a* of the first block 4 and the inner face 15*b* of the second block 5, and the inner faces 15*a* and 15*b* are positioned in the same plane. In this regard, the slit die 104 is different from the embodiments shown in FIGS. 2, 4, 5 and 6.

In this constitution, the slit die 104 has a gap between the inner face 17*a* of the second lip 2 and the inner face 15*a* of the first block 4. The gap is filled with a shim 113. When the slit die 104 is assembled, the shim 113 is set between the first lip 3 and the second lip 2, and clamped and fixed by the first block 4 and the second lip 2. The shim 113 forms position difference H2.

Figure 8:
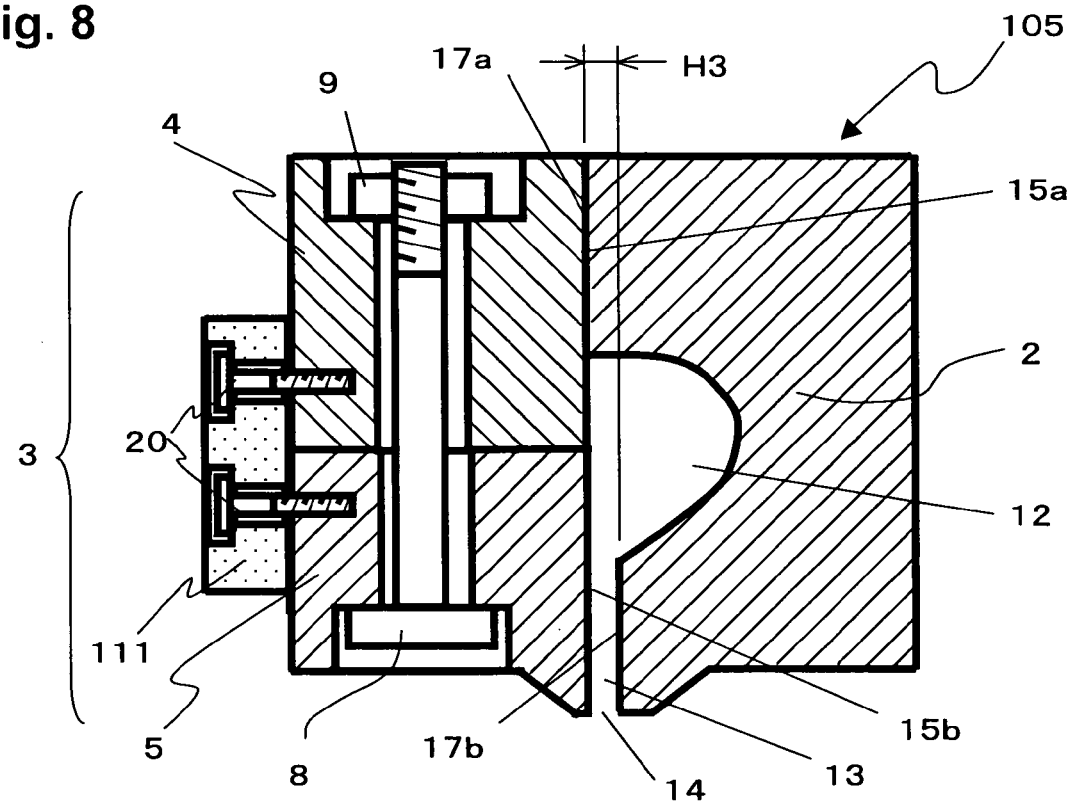
FIG. 8 is a transverse sectional view of the slit die of another embodiment of the invention.

FIG. 8 shows a further other embodiment of the slit die of the invention. In the slit die 105 of FIG. 8, the inner face 17*a* of the second lip 2 is projected toward the inner face 15*a* of the first block 4 by a distance corresponding to the thickness of the shim 113 in the slit die 104 shown in FIG. 7, to keep the inner face 17*a* and the inner face 15*a* in contact with each other, to thereby form position difference H3. In the other portions of the structure, the slit die 105 is the same as the slit die 104 of FIG. 7.

Several embodiments have been explained. The essential structure of the slit die of the invention is such that a pair of lips combined can form a lip gap, that at least one of the lips comprises at least two independent blocks, and that the positioning elements for deciding the relative position between the blocks and the elements for fixing the positioning elements are provided for the blocks, for allowing the gap width of the lip gap to be corrected in the longitudinal direction of the lip gap. That is, if this structure is satisfied, individual components and their combination can be arbitrary.

In the slit die 104 shown in FIG. 7 or in the slit die 105 shown in FIG. 8, the lip gap accuracy in the order of submicrons can be achieved by establishing fine position differences among the flat blocks 111, for the relative position between the first block 4 and the second block 5 constituting the first lip 3, in response to the desired lip gap accuracy.

The manifold 12 in the slit die 1 can also be installed in the first lip 3, not in the second lip 2, or in each of the first lip 3 and the second lip 2.

The front form of the manifold 12 can be T shape extended on both sides in the longitudinal direction with the coating liquid feed port 11 as the center as shown in FIG. 1, or a coat hanger shape inclined on both sides in the longitudinal direction with the coating liquid feed port 11 as the center. Instead of one manifold 12, plural manifolds can also be installed in steps in the coating liquid discharge direction. The manifold 12 can also be provided through both the ends in the longitudinal direction of the lips. In this case, side plates installed at both the ends in the longitudinal direction of the lips are used to decide the coating liquid discharge width and to seal the liquid leak.

The coating liquid feed means not shown in the drawings can be any publicly known means. Examples of the coating liquid feed means include a gear pump, Moineau pump, diaphragm pump and syringe pump. In the coating liquid passage between the coating liquid feed means and the slit die 1, publicly known filters and valves can be installed as required.

In the slit die of the invention, the material of the lips is not especially limited. Examples of the material include cemented carbide, ceramic, stainless steel or any of these materials surface-treated. Stainless steel is preferred as the material in view of chemicals resistance and low price.

The length LA of the tip 18 of the second lip 2 and the length LB of the tip 19 of the first lip 3 respectively shown in FIG. 2 can be set as desired in response to the direction in which the coating film is formed. For example, in the case where the member to be coated is relatively moved from the second lip 2 toward the first lip 3 for forming the coating film on the downstream side of the second lip 3, it is desirable that the length LA of the tip 18 of the second lip 2 is preferably from 0.1 mm to 15 mm, more preferably from 0.5 mm to 5 mm, and that the length LB of the tip 19 of the first lip 3 is preferably from 0.03 mm to 2 mm, more preferably from 0.05 mm to 1 mm, and in addition, that the length LB of the tip 19 of the first lip 3 is shorter than the length LA of the tip 18 of the second lip 2.

It is preferred that the straightness of the tip 18 of the second lip 2 and of the tip 19 of the first lip 3 in the longitudinal direction, namely, the macroscopic magnitude of waviness in the longitudinal direction is 10 μm or less. More preferred is 5 μm or less.

It is preferred that the surface roughness of the wetted face as maximum height (Ry) is 0.4 S or less. More preferred is 0.2 S or less. It is further preferred that the tip 18 of the second lip 2 and the tip 19 of the first lip 3 are finished to be 0.1 S or less, since the coating quality can be kept good.

Embodiments of the method and apparatus for producing a substrate with coating films using the slit die of the invention are explained below.

Figure 9:
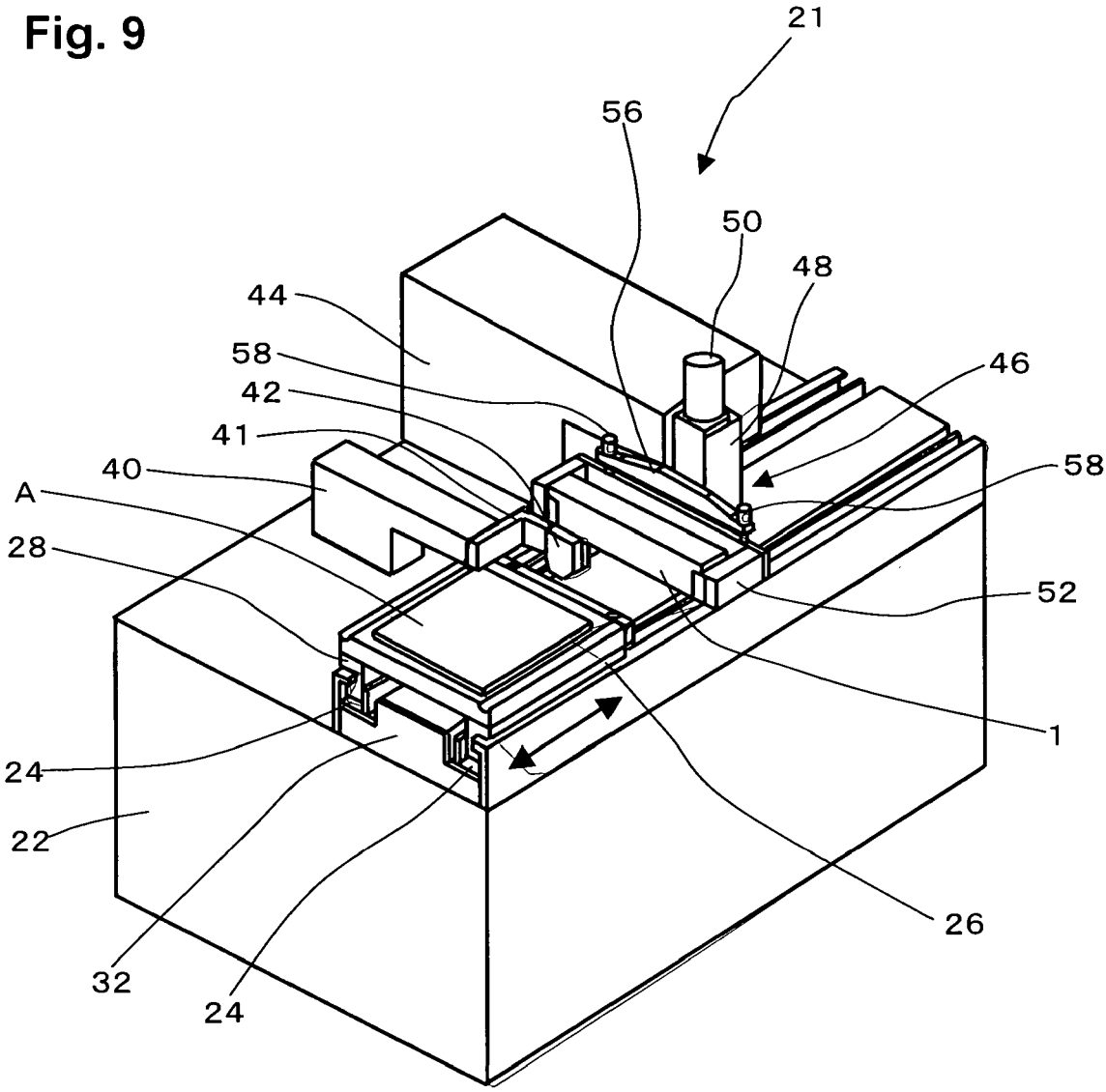
FIG. 9 is a schematic perspective view showing an apparatus (die coater) for carrying out the method for producing a substrate with coating films of the invention.
Figure 10:
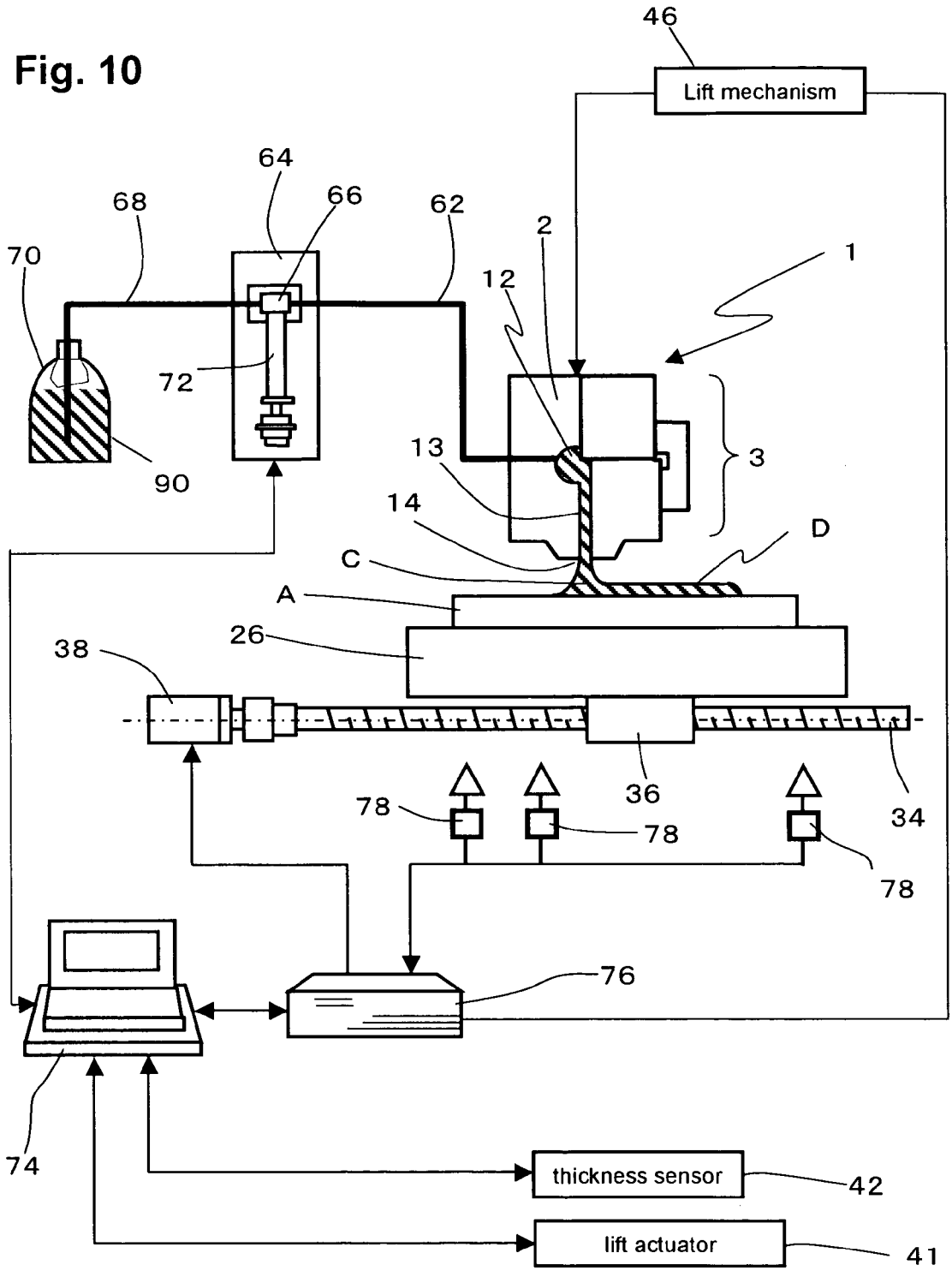
FIG. 10 is a schematic system diagram for explaining a coating liquid feed system, a coating liquid coating procedure and a control system for it in the die coater of FIG. 9, as an example.

FIG. 9 is a schematic perspective view showing a die coater using the slit die of the invention for carrying out the method for producing a substrate with coating films of the invention. FIG. 10 is a schematic constitutional diagram showing the die coater of FIG. 9 including the coating liquid feed system.

FIG. 9 shows a die coater 21 for coating a unit substrate such as a glass substrate (member to be coated) with a coating liquid for forming a coating film. The die coater 21 has a base 22. On the base 22, a pair of guide groove rails 24 is installed, and a stage 26 is arranged on the guide groove rails 24. The top face of the stage 26 is formed as a suction face. The stage 26 can be reciprocated on the guide groove rails 24 by means of a pair of slide legs 28 in the horizontal direction.

Between the pair of guide groove rails 24, a casing 32 extending along the guide groove rails 24 is disposed, and the casing 32 contains a feed mechanism. The feed mechanism has a feed screw 34 composed of a ball screw as shown in FIG. 10. The feed screw 34 is engaged with a nut-like portion of a connector 36 having the nut-like portion fixed under the stage 26, and extends through the connector 36. Both the ends of the feed screw 34 are supported by bearings not shown in the drawing in such a manner that it can be revolved. One of the ends is connected with an AC servo motor 38. In the top face or lateral face of the casing 32, an opening to allow the movement of the connector 36 is formed, though it is not shown in the drawing.

In this embodiment, the stage 26 can be reciprocated, but instead of this method, the slit die 1 can also be reciprocated relatively to the stage 26. It is only required that at least either the stage 26 or the slit die 1 can be reciprocated.

On the top face of the base 22, a reverse L-shaped sensor prop 40 is disposed on one side. The tip of the sensor prop 40 extends to above one of the guide groove rails 24, and a motor-operated lift actuator 41 is installed there. To the lift actuator 41, a thickness sensor 42 is installed to face downward. The thickness sensor 42 can be a laser displacement meter, ultrasonic thickness gauge or the like. Above all, a sensor using a laser is preferred.

On the top face of the base 22, a die prop 44 reverse L-shaped like the sensor prop 40 is disposed at a position on the more center side of the base 22 than the sensor prop 40. The tip of the die prop 44 is positioned above the intermediate position between the pair of guide groove rails 24, namely, above the reciprocation route of the stage 26. At the tip of the die prop 44, a lift mechanism 46 is installed. Though not shown in detail in FIG. 9, the lift mechanism 46 has a lift bracket. The lift bracket is attached to a pair of guide rods so that it can be raised and lowered. Between the guide rods, a feed screw composed of a ball screw is disposed, and the feed screw is screwed into a nut portion of the lift bracket and extends through the nut portion.

The top end of the feed screw is connected with an AC servo motor 50 that is installed on the top face of a casing 48. Meanwhile, said guide rods and feed screw are accommodated in the casing 48 and supported through bearings in such a manner that they can be revolved.

A die holder 52 comprising a flat plate and lateral plates provided at both the ends of the flat plate is installed to the lift bracket in such a manner that it can be revolved around a support shaft (not shown in the drawing) within a vertical plane. The die holder 52 extends horizontally across the pair of guide groove rails 24 above said guide groove rails.

A horizontal bar 56 is fixed to the lift bracket at a position above the die holder 52, and the horizontal bar 56 extends along the die holder 52. Motor-operated control actuators 58 are installed at both the ends of the horizontal bar 56. The control actuators 58 have expansible rods projected from the bottom face of the horizontal bar 56, and the bottom ends of the expansible rods are kept in contact with both the ends of the die holder 52.

Inside the die holder 52, the slit die 1 of the invention is installed. As shown in FIG. 10, from the slit die 1, a feed hose 62 for a coating liquid 90 extends, and the tip of the feed hose 62 is connected with a feed port of an electromagnetic selector valve 66 of a syringe pump 64. From the suction port of the electromagnetic selector valve 66, a suction hose 68 extends, and the tip of the suction hose 68 is inserted into a tank 70 storing the coating liquid 90.

The pump proper 72 of the syringe pump 64 can be selectively connected with either the feed hose 62 or the suction hose 68 by the selection action of the electromagnetic selector valve 66. The electromagnetic selector valve 66 and the pump proper 72 are electrically connected with a computer 74, so that they can receive control signals from the computer 74, for being controlled in their actions. The computer 74 is also electrically connected with the lift actuator 41 and the thickness sensor 42.

For controlling the action of the syringe pump 64, the computer 74 is also electrically connected with a sequencer 76. The sequencer 76 is provided for sequence-controlling the action of the AC servo motor 38 of the feed screw 34 on the stage 26 side and the action of the AC servo motor 50 of the lift mechanism 46. For the sequence control, the signals indicating the action states of the AC servo motors 38 and 50, the signals from the position sensors 78 detecting the moving position of the stage 26, the signal from the sensor (not shown in the drawing) detecting the action state of the slit die 1, and the like are applied to the sequencer 76. On the other hand, from the sequencer 76, signals showing the sequence actions are delivered to the computer 74.

Instead of using the position sensors 78, the AC servo motor 38 can contain an encoder, so that the sequencer 76 can detect the position of the stage 26 based on the pulse signals delivered from the encoder. The control by the computer 74 can also be incorporated into the sequencer 76.

Though not shown in the drawing, the die coater 21 has a loader for feeding a unit substrate as the member to be coated, for example, a glass substrate A for a color filter onto the stage 26 and an unloader for removing the glass substrate A from the stage 26. In the loader and the unloader, for example, cylindrical-coordinate industrial robots can be used as main components of them.

As can be seen from FIG. 9, the slit die 1 extends horizontally in the direction perpendicular to the reciprocating direction of the stage 26, namely, in the width direction of the stage 26, and is supported by the die holder 52.

The slit die 1 can be horizontally adjusted by expanding or contracting the expansion rods of the control actuators 58 provided at both the ends of the horizontal bar 56 and revolving the die holder 52 around its support shaft.

Next, one process in the production of a color filter, that is, the method for producing a substrate with a coating film using said die coater 21 is explained below.

In FIGS. 9 and 10, at first, the respective working parts of the die coater 21 are returned to their home positions. In this phase, the stage 26 is positioned below the thickness sensor 42. Furthermore, at this step, the route from the tank 70 through the suction hose 68 and the feed hose 62 to the manifold 12 and the lip gap 13 in the slit die 1 is filled with the coating liquid 90. Moreover, in this phase, as an action in preparation for coating, the electromagnetic selector valve 66 of the syringe pump 64 is actuated so that the pump proper 72 can be connected with the suction hose 68. With this action, the coating liquid 90 in the tank 70 is sucked into the pump proper 72 through the suction hose 68. If a predetermined amount of the coating liquid 90 is sucked into the syringe pump 64, the electromagnetic selector valve 66 of the syringe pump 64 is actuated so that the pump proper 72 can be connected with the feed hose 62.

In this state, a glass substrate A is fed from the loader not shown in the drawing onto the stage 26, and the glass substrate A is held on the stage 26, while receiving suction pressure. In this way, the loading of the glass substrate A is completed. The glass substrate A has a width substantially equal to or wider than the discharge width of the discharge opening 14 in the slit die 1, namely, the distance Lw between the sealing plates 6*a* and 6*b*.

If the loading of the glass substrate A is completed, the thickness sensor 42 is lowered to a predetermined position, and the thickness of the glass substrate A is measured by the thickness sensor 42. After completion of measurement, the thickness sensor 42 is raised to the original position.

If the loading of the glass substrate A is completed, the stage 26 is moved toward the slit die 1 and is stopped immediately before the slit die 1. Subsequently, the slit die 1 is lowered, and a predetermined clearance, for example, a clearance of 100 μm is secured between the bottom face of the slit die 1 and the top face of the glass substrate A. For the clearance, the thickness of the glass substrate A measured by the thickness sensor 42 is taken into account, and based on the output signal from the distance sensor (not shown in the drawing) used for measuring the distance between the stage 26 and the slit die 1, the descending position of the slit die 1 is decided and accurately set.

Next, the stage 26 is moved further, and at the time point when the start line at which the formation of a coating film should be started on the top face of the glass substrate A is positioned right under the discharge opening 14 of the slit die 1, the stage 26 is once stopped.

Substantially as soon as the stage 26 is once stopped, the syringe pump 64 is made to start discharging the coating liquid 90, to feed the coating liquid 90 toward the slit die 1. Thereby, the coating liquid 90 is discharged from the discharge opening 14 of the slit die 1 onto the glass substrate A. In this case, since the gap of the discharge opening 14 is constant in the longitudinal direction of the slit die 1, namely, in the direction perpendicular to the reciprocating direction of the stage 26, the coating liquid 90 is discharged uniformly along the start line of the glass substrate A from the discharge opening 14. As a result, a liquid bank C of the coating liquid called bead is formed along the start line between the slit die 1 and the glass substrate A.

As soon as the liquid bank C is formed, while the discharge of the coating liquid 90 from the discharge opening 14 is continued, the stage 26 is made to progress in the reciprocating direction at a certain speed, to continuously form a coating film D of the coating liquid 90 on the top face of the glass substrate A as shown in FIG. 10.

When the coating film D is formed, the coating liquid 90 may also be discharged from the discharge opening 14 at the timing at which the start line of the glass substrate A passes under the discharge opening 14 of the slit die 1, without once stopping the movement of the stage 26.

With the progression of the stage 26, the finish line at which the formation of the coating film D on the glass substrate A should be finished reaches the position immediately before the discharge opening 14 of the slit die 1. At this time point, the discharge action of the syringe pump 64 is stopped. Even if the discharge of the coating liquid 90 from the discharge opening 14 of the slit die 1 is stopped in this way, the formation of the coating film D is continued till the finish line while the coating liquid of the liquid bank C on the glass substrate A is consumed. The discharge action of the syringe pump 64 can also be stopped at the time point when the finish line on the glass substrate A has passed the discharge opening 14 of the slit die 1.

At the time point when the finish line on the glass substrate A passes or has passed the discharge opening 14, the syringe pump 64 is made to act for sucking slightly, and as a result, the coating liquid 90 in the lip gap 13 of the slit die 1 is sucked toward the manifold 12. At the same time, the slit die 1 is raised to the original position, to finish the application of the coating liquid 90 by the slit die 1.

Then, the syringe pump 64 is made to act for discharge the same amount as that sucked, so that no air should remain in the lip gap 13 of the slit die 1. Subsequently, the electromagnetic selector valve 66 of the syringe pump 64 is actuated so that the pump proper 72 can be connected with the suction hose 68, and the pump proper 72 is made to act for sucking the coating liquid in the tank 70 through the suction hose 68. If a predetermined amount of the coating liquid is sucked into the syringe pump 64, the electromagnetic selector valve 66 of the syringe pump 64 is actuated so that the pump proper 72 can be connected with the feed hose 62. Subsequently, while the slit die 1 is kept at its high position, the coating liquid 90 deposited on the bottom end of the slit die 1 is wiped off by a cleaner (not shown in the drawing).

On the other hand, the forward movement of the stage 26 is continued even if the application of the coating liquid 90 is finished, and the time point when the stage 26 has reached the ends of the guide groove rails 24, the forward movement is stopped. In this state, the glass substrate A with the coating film D formed is liberated from suction and taken away from the stage 26 by the unloader. Subsequently the stage 26 is moved backward and returned to the initial position shown in FIG. 9, to complete a series of coating process. At the initial position, the stage 26 stands by till it is loaded with a new glass substrate.

The coating liquid 90 used for forming the coating film is not especially limited if it is a flowable liquid. Examples of the coating liquid include a coating liquid for coloration, a coating liquid for resist, a coating liquid for surface protection, a coating liquid for antistatic treatment, a coating liquid for lubrication, etc. Coating liquids obtained by dissolving or dispersing a polymeric material or an inorganic material such as glass or metal into water or an organic solvent are often used.

It is preferred that the viscosity of the coating liquid 90 used is from 1 mPa·s to 100,000 mPa·s. A more preferred range is from 5 mPa·s to 50,000 mPa·s. A Newtonian coating liquid is preferred in view of coating property, but a thixotropic coating liquid can also be used.

As the substrate A, a metallic sheet such as aluminum sheet, ceramic sheet, a silicone wafer or the like can also be used in addition to a glass substrate.

Among the coating conditions employed, it is preferred that the clearance (if necessary) is from 20 μm to 500 μm. A more preferred range is from 50 μm to 400 μm. It is preferred that the coating speed is from 0.1 m/min to 50 m/min. A more preferred range is from 0.5 m/min to 10 m/min. It is preferred that the lip gap is from 30 μm to 1,000 μm. A more preferred range is from 50 μm to 600 μm. It is preferred that the coating thickness is from 3 μm to 500 μm. A more preferred range is from 5 μm to 300 μm.

The method for producing a substrate with coating films of the invention can be preferably used for producing a member for a display. Examples of the member for a display include a color filter used for a liquid crystal display, a back plate and a front plate of a plasma display, etc.

In the above-mentioned embodiments, application to a unit substrate such as a glass substrate has been explained. Application to a long web (a long member to be coated) such as a film, metallic sheet, metallic foil or paper can be realized by bringing the slit die 1 of the invention closer to the web at a portion where it is supported and carried by means of a roll, and discharging the coating liquid from the discharge opening 14 of the slit die 1.

Next, another embodiment of the method for producing a substrate with coating films of the invention is explained below.

Figure 14:
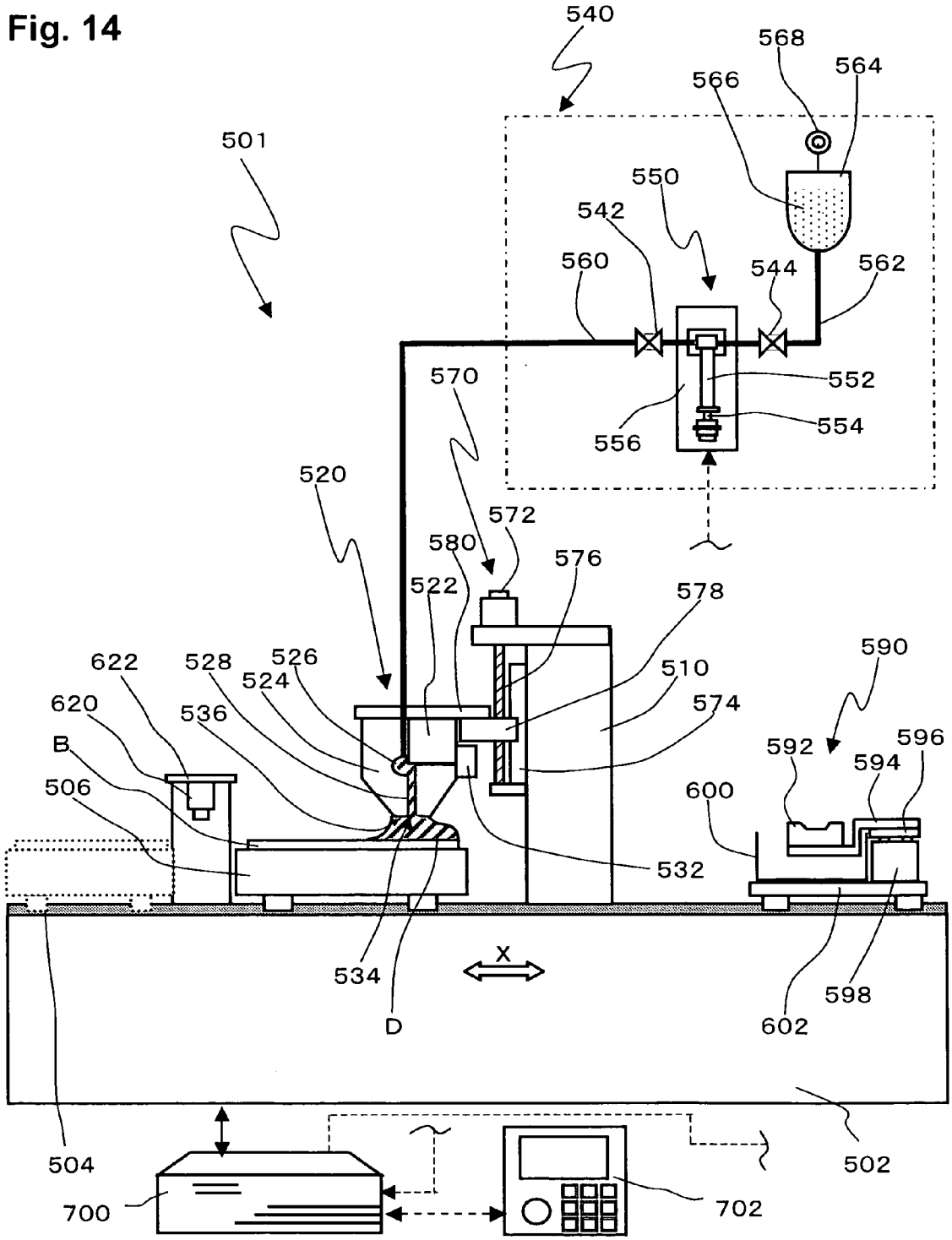
FIG. 14 is a schematic system diagram for explaining a coating liquid feed system, a coating liquid coating procedure and a control system for it in the apparatus (die coater) for carrying out the method for producing a substrate with coating films of the invention, as another example.
Figure 15:
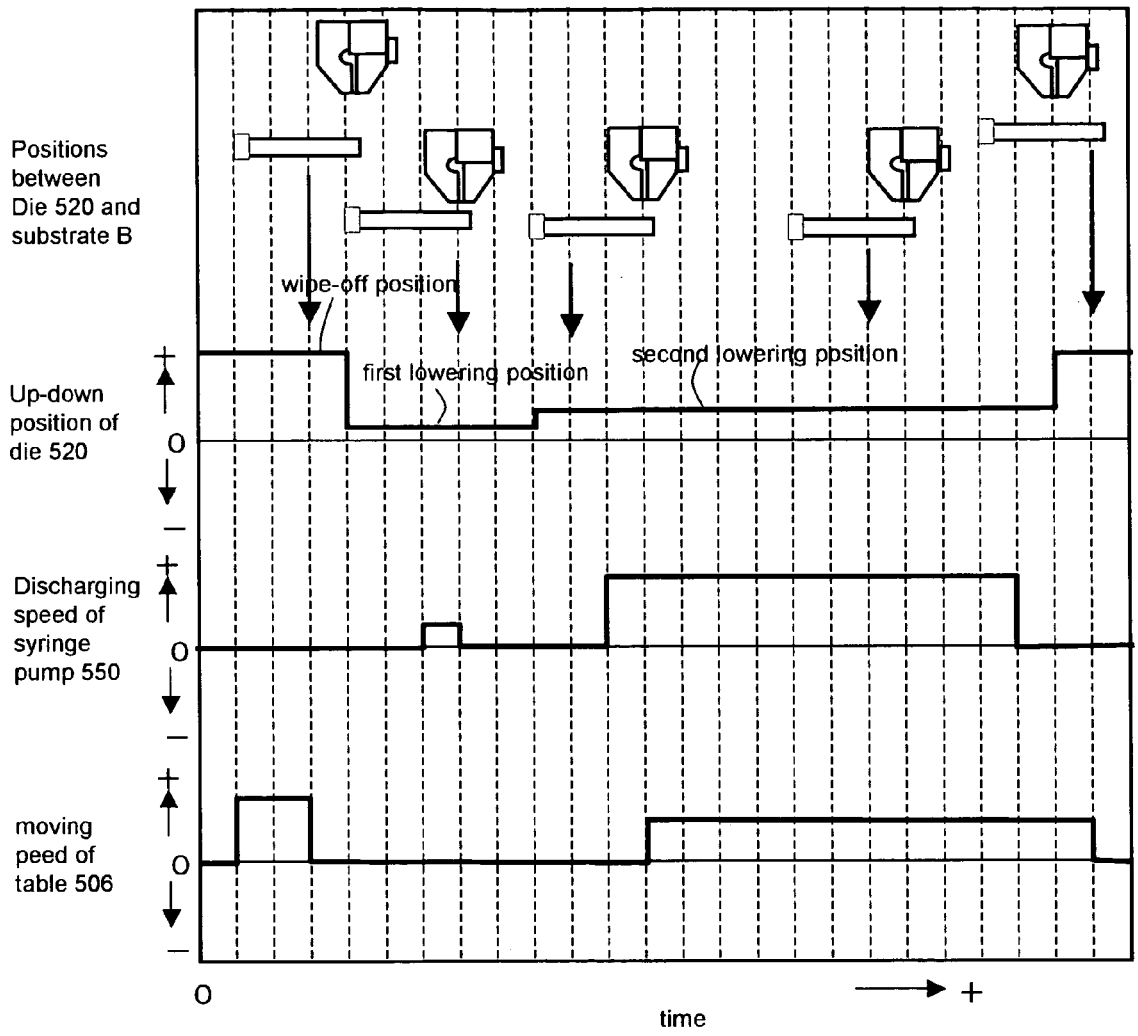
FIG. 15 is a time chart for explaining the actions of respective parts when the die coater of FIG. 14 is used for coating a substrate with a coating liquid.
Figure 16A:
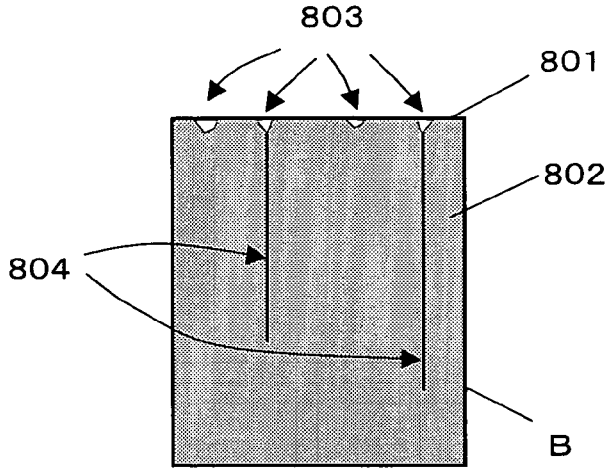
FIG. 16A is a plan view for explaining a non-preferred coating state of a coating liquid on a substrate.
Figure 16B:
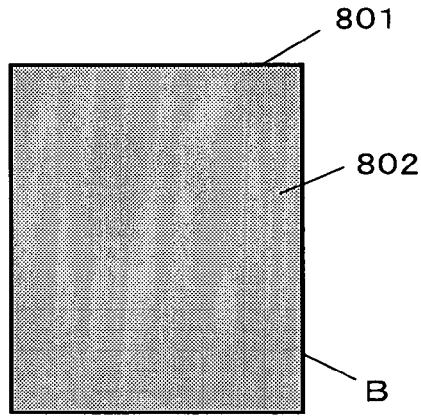
FIG. 16B is a plan view for explaining a preferred coating state of a coating liquid on a substrate.
Figure 17:
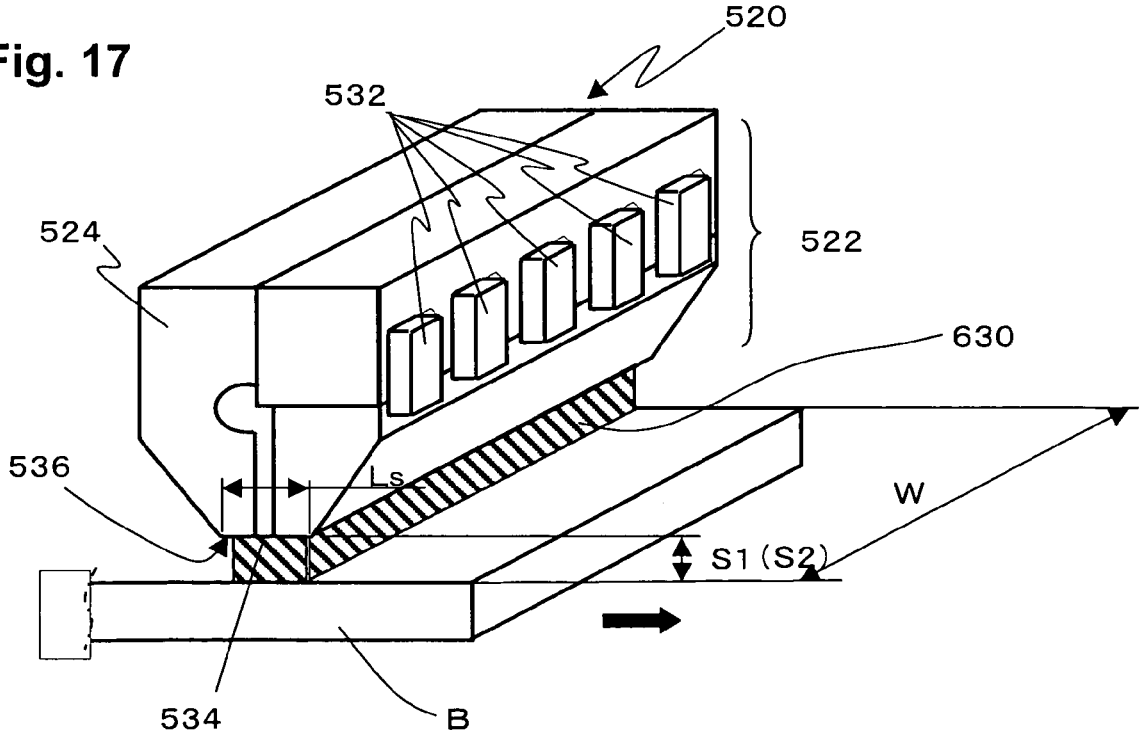
FIG. 17 is a schematic perspective view for explaining the bead formed between the slit die of FIG. 14 and a substrate.

FIG. 14 is a schematic front sectional view showing an example of the coater used for carrying out the method for producing a substrate with coating films of the invention. FIG. 15 is a time chart showing the action states of respective working parts when the coater of FIG. 14 is used for coating. FIG. 16A and FIG. 16B are plan views for explaining the states where a coating film is formed on a substrate. FIG. 17 is a schematic perspective view for explaining the state where bead is formed between a slit die and a substrate.

In FIG. 14, a coater (a die coater) 501 has a base 502, and a pair of guide rails 504 is installed on the base 502. On the guide rails 504, a stage 506 is arranged, and the stage 506 can be driven by a linear motor not shown in the drawing, for being reciprocated in the arrow X directions. The top face of the stage 506 is a vacuum suction face with suction holes, so that the substrate B as the member to be coated can be sucked and held.

At the center of the base 502, a gate-shaped prop 510 is installed. On both sides of the prop 510, vertical lift units 570 are provided, and the slit die 520 of the invention used for coating is installed in the vertical lift units 570.

The slit die 520 is composed in such a manner that a front lip 522 and a rear lip 524 respectively extending in the direction perpendicular to the arrow X directions, namely, in the direction perpendicular to the paper surface are overlaid in X directions and integrally combined using plural connection bolts not shown in the drawing.

The front lip 522 is composed in such a manner that two blocks different in thickness are overlaid with one on the other, with their outer faces positioned in the horizontal direction (X directions) by a positioning block 532. The positioning block 532 is fixed to the two blocks constituting the front lip 522 using elements (not shown in the drawing) for fixing the positioning block 532.

At the center of the die 520, a manifold 526 is formed, and the manifold 526 also extends in the longitudinal direction of the die 520 (horizontal direction perpendicular to the X directions). Under the manifold 526, a lip gap (slit) 528 is formed to communicate with the manifold 526. The slit 528 also extends in the longitudinal direction of the die 520, and the bottom end opens at the discharge opening face 536 corresponding to the lowest end face of the die 520, to form a discharge opening 534. The gap width (slit width) (measured in the X directions) of the slit 528 is equal to the difference between the thicknesses of the two blocks constituting the front lip 522.

The vertical lift units 570 for lifting and lowering the die 520 comprises a suspending/holding base 580 for suspending and holding the die 520, a pair of lift bases 578 for lifting and lowering the suspending/holding base 580, guides 574 for guiding the lift bases 578 in the vertical direction, and ball screws 576 for converting the revolving motion of motors 572 into the straight motion of the lift bases 578.

The vertical lift units 570 are provided as a pair for supporting both the ends of the die 520 in the longitudinal direction and can be raised and lowered respectively independently. So, the inclination angle of the die 520 in reference to the level in the longitudinal direction can be set as desired. In this constitution, the discharge opening face 536 of the die 520 and the substrate B can be kept virtually parallel to each other in the longitudinal direction of the die 520. Furthermore, the vertical lift units 570 can be used to set a clearance with a desired size between the substrate B on the stage 506 and the discharge opening face 536 of the die 520.

In FIG. 14, on the right end of the base 502, a wipe-off unit 590 is placed on the guide rails 504 in such a manner that it can be moved in the X directions. In the wipe-off unit 590, a wipe-off head 592 shaped to allow engagement with the area at and near the discharge opening 534 of the die 520 is installed on a slider 596 through a bracket 594. The slider 596 can be moved by a drive unit 598 in the longitudinal direction of the die 520, namely, in the horizontal direction perpendicular to the X directions.

The drive unit 598 and a tray 600 are fixed on a carriage 602. The carriage 602 is placed on the guide rails 504 and can be reciprocated in the X directions by a linear motor not shown in the drawing, being guided by the guide rails 504. So, the wipe-off unit 590 as a whole can be reciprocated in the X directions. For wiping off, the unit 590 as a whole is moved in the X directions, and the die 520 is lowered and engaged with the wipe-off head 592. If the drive unit 598 is driven for allowing the wipe-off head 592 to slide in the longitudinal direction of the die 520, the coating liquid 566 and other contaminant remaining near the discharge opening of the die 520 can be removed for cleaning.

The removed coating liquid 566 and other contaminant are collected by the tray 600. The tray 600 is connected with a discharge line not shown in the drawing, and the liquid such as the coating liquid 566 and other contaminant collected inside can be discharged and collected. The tray 600 can also be used to collect the coating liquid 566 discharged from the die 520 by air venting or the like. It is preferred that the wipe-off head 592 is formed of an elastic material such as rubber or synthetic resin so that it can be uniformly engaged with the die 520.

On the left side of the base 502, a thickness sensor 620 for measuring the thickness of the substrate B is installed in a support base 622. It is preferred that the thickness sensor 620 uses a laser. If the thickness sensor 620 is used to measure the thickness of the substrate B, the clearance as the gap between the discharge opening face 536 of the die 520 and the substrate B can be always kept constant irrespectively of the thickness of the substrate B.

The upstream side of the manifold 526 of the die 520 is always connected through an internal passage (not shown in the drawing) with a feed hose 560 communicating with a coating liquid feeder 540. In this constitution, the coating liquid can be fed to the manifold 526 from the coating liquid feeder 540. The coating liquid 566 entering the manifold 526 is uniformly widened to flow in the longitudinal direction of the die 520, and is discharged through the slit 528 from the discharge opening 534.

The coating liquid feeder 540 comprises a feed valve 542, a syringe pump 550, a suction valve 544, a suction hose 562 and a tank 564 on the upstream side of the feed hose 560. The tank 564 stores the coating liquid 566, and is connected with a compressed air source 568, so that a back pressure with a desired magnitude can be applied to the coating liquid 566.

The coating liquid 566 in the tank 564 is fed to the syringe pump 550 through the suction hose 562. The syringe pump 550 has a pump proper 556 comprising a syringe 552 and a piston 554. The piston 554 can be reciprocated in the vertical direction by a drive source not shown in the drawing. In the syringe pump 550, the syringe 552 with a certain inner diameter is filled with the coating liquid 566 that is pressed out by the piston 554 and fed to the die 520. The syringe pump 550 is a fixed delivery pump that can feed the coating liquid 566 by an amount corresponding to the amount necessary for coating one substrate B by one stroke of action.

When the syringe 552 is filled with the coating liquid 566, the suction valve 544 is opened while the feed valve 542 is closed, and the piston 554 is moved downward. Furthermore, when the coating liquid 566 filling the syringe 552 is fed toward the die 520, the suction valve 544 is closed while the feed valve 542 is opened, and the piston 554 is moved upward, so that the coating liquid 566 in the syringe 552 can be pressed up and discharged by the piston 554. It is preferred that an O ring not shown in the drawing is attached to the piston 554 for ensuring the air tightness between the male piston 554 and the female syringe 552.

The linear motor, the motor 572, the coating liquid feeder 540, etc. operated by control signals are electrically connected with a controller 700. According to an automatic operation program contained in the controller, control command signals are sent to respective apparatuses for performing predetermined actions. For changing a condition, if a changed parameter is entered into a control panel 702 as required, it can be transmitted to the controller 700, to change the operation action.

Next, a method for producing a substrate with a coating film using the die coater 501 is explained below.

At first, if the respective working parts of the die coater are returned to their home positions, the respective moving portions are moved to standby positions. That is, the stage 506 is moved to the left end (the position indicated by a broken line) of FIG. 14, and the die 520 is moved to the top position. The wipe-off unit 590 is moved to ensure that the tray 600 comes to the position below the die 520. At this time, it is assumed that the coating liquid passage from the tank 564 to the die 520 is already filled with the coating liquid 566, and that the work of discharging the air remaining in the die 520 has already been completed.

As for the status of the coating liquid feeder 540 at this time, the syringe 552 is filled with the coating liquid 566, and the suction valve 544 is closed while the feed valve 542 is opened, the piston 554 being positioned at the lowest end, for allowing the coating liquid 566 to be fed to the die 520 at any time.

In this state, at first, lift pins not shown in the drawing are raised above the surface of the stage 506, and the substrate B is loaded from a loader not shown in the drawing, onto the lift pins. Then, the lift pins are lowered to place the substrate B on the top face of the stage 506, and at the same time, the substrate B is sucked and held.

Concurrently, the coating liquid feeder 540 is actuated to discharge a small amount of the coating liquid 566 toward the tray 600, and the wipe-off unit 590 is moved so that the wipe-off head 592 comes to the position right under the discharge opening 534 of the die 520. Then, the die 520 is lowered so that the discharge opening face 536 of the die 520 can be engaged with the wipe-off head 592. Subsequently the wipe-off head 592 is made to slide in the longitudinal direction of the die 520, for cleaning the area at and near the discharge opening 534 of the die 520. After completion of cleaning, the wipe-off unit 590 is returned to the original position (the right end of FIG. 14).

Then, the coating liquid feeder 540 is again actuated to discharge a certain amount of the coating liquid 566 from the discharge opening 534 of the die 520. Since the amount of the coating liquid 566 discharged this time is very small, the coating liquid does not drop downward from the discharge opening 534, but remains as hanging from the discharge opening 534 and its surrounding discharge opening face 536. In this case, if there are slight voids near the discharge opening 534 of the slit 528, the coating liquid 566 is pressed outside the discharge opening 534. The coating liquid 566 discharged from the discharge opening 534 has a nature of flowing along the discharge opening 534 in the longitudinal direction of the discharge opening 534. So, even if there are voids in the slit 528 as portions free from the coating liquid 566 pressed out, the flow of the coating liquid 556 in the longitudinal direction eliminates the voids, and the area under the discharge opening 534 is filled with the coating liquid 566 continuing in the longitudinal direction. The length of the coating liquid 566 hanging from the discharge opening 534, which continues in the area under the discharge 534, is made uniform in the longitudinal direction of the die 520 due to the action of surface tension.

The amount discharged from the discharge opening 534 is explained below in reference to FIG. 17. In FIG. 17, if the length of the face including the discharge opening 534 of the die 520, namely, the discharge opening face 536 in the coating direction is Ls, the length of the discharge opening 534 in the longitudinal direction of the die 520 is W, and the clearance between the discharge opening face 536 and the substrate B during coating described later is S1, then it is preferred that the discharged amount is from 5% to 100% of the volume expressed by S1×Ls×W. A more preferred range is from 10% to 50% of the volume. If the rate to the volume is $\alpha 1$, the range of the rate $\alpha 1$ is expressed as $0.05 \leqq \alpha 1 \leqq 1.0$.

If the discharged amount is smaller than the range, the amount of the coating liquid 566 discharged from the discharge opening 534 and migrating in the longitudinal direction is small, and the migration velocity is low. So, the voids formed in other portions cannot be substantially removed. If the discharged amount is larger than the range, the coating liquid 566 overflows from the clearance formed between the discharge opening face 536 and the substrate B, and the thickness of the coating film at the coating start portion becomes larger than the allowable value.

The above-mentioned discharged amount must be kept to stand by for a certain period of time after it has been discharged from the discharge opening 534. The time (standby time) is necessary for the discharged coating liquid 566 to hang down from the discharge opening 534 and to be uniformed in the longitudinal direction of the die 520 due to the action of surface tension. It is preferred that the standby time is from 0.1 second to 10 seconds. A more preferred range is from 0.3 second to 3 seconds. A standby time shorter than the range is not preferred since uniformity cannot be achieved, and a time longer than it is not preferred either since the tact time becomes very long.

Concurrently with the above action, the movement of the stage 506 is started. The thickness of the substrate B passing under the thickness sensor 620 is measured. At the time point when the coating start portion 801 of the substrate B reaches the position right under the discharge opening 534 of the die 520, the movement of the stage 506 is stopped. The vertical lift units 570 are driven to let the discharge opening face 536 of the die 520 approach the position where a clearance of a size preset against the substrate B is secured. For setting the clearance, the measured thickness data of the substrate B is used.

Then, the piston 554 of the syringe pump 550 is raised at a predetermined speed, to discharge the coating liquid 566 from the die 520 for a certain period of time, and subsequently the movement of the stage 506 is started at a predetermined speed, while the coating of the substrate B with the coating liquid 566 is started to form a coating film.

When the coating end portion of the substrate B has come to the position of the discharge opening 534 of the die 520, the piston 554 is stopped to stop the feed of the coating liquid 566, and in succession, the vertical lift units 570 are driven to raise the die 520. As a result, the bead formed between the substrate B and the die 520 are cut off, to finish coating.

During these actions, the stage 506 is kept moving and stopped when it comes to the end position and the substrate B is released from suction. The lift pins are raised to lift the substrate B. At this moment, an unloader not shown in the drawing holds the bottom face of the substrate B and carries the substrate B to the subsequent process.

After the substrate B is transferred to the unloader, the stage 506 lowers the lift pins and is returned to its home position. After the stage 506 has been returned to the home position, the wipe-off unit 590 is moved so that the tray 600 comes to the position under the discharge opening 534 of the die 520.

Then, the syringe pump 550 is actuated to feed a small amount (10 μL to 500 μL) of the coating liquid 566 into the die 520, to fill the voids remaining in the die 520 with the coating liquid 566.

After completion of this action, in the syringe pump 550, the suction valve 544 is opened while the feed valve 542 is closed, and the piston 554 is lowered at a certain speed, to fill the syringe 552 with the coating liquid 566 of the tank 564. After completion of filling, the piston 554 is stopped, and the suction valve 544 is closed while the feed valve 542 is opened, for standing by till the next new substrate B comes. Whenever a new substrate B comes, the same actions are repeated.

In the above-mentioned method for producing a substrate with a coating film, before start of coating, a very slight certain amount of the coating liquid 566 is discharged from the discharge opening 534 of the die 520, so that the coating liquid 566 can form a void-less state in the slit 528 and near the discharge opening 534, and subsequently coating is started. So, the coating film 802 at the coating start portion 801 of the substrate B is uniform without the non-coated spots 803 as shown in FIG. 16B. If a very slight certain amount of the coating liquid 566 is not discharged unlike the above case, the coating film 802 at the coating start portion 801 of the substrate B has the non-coated spots 803 as shown in FIG. 16A. If the coating is continued in this state, the non-coated spots 803 form streaks 804 as a defect.

In the above-mentioned embodiment, the wipe-off head 592 made of an elastic material is engaged with the area at and near the discharge opening 534 of the die 520 and is slid, to clean the area at and near the discharge opening 534 of the die 520. However, a cloth or a cloth wetted with a solvent can also be used to wipe off the area at and near the discharge opening 534 of the die 520.

A further other embodiment of the method for producing a substrate with coating films of the invention is explained below.

In the die coater 501 of FIG. 14, at first, the coating liquid passage from the tank 564 to the die 520 is filled with the coating liquid 566, and the stage 506, the die 520 and the wipe-off unit 590 are kept in standby positions. These actions are quite the same those in the above-mentioned method for producing a substrate with a coating film using the die coater 501 of FIG. 14.

The subsequent actions of the stage 506, the die 520 and the syringe pump 550 are explained below in reference to the time chart of FIG. 15. After confirming that the wipe-off unit 590 has moved to the right end of the base 502, the movement of the stage 506 mounted with the substrate B is started. At this time, the die 520 is in the wipe-off position far above the coating position, and on the other hand, the syringe pump 550 stands by and is still stationary. Then, when the substrate B passes under the thickness sensor 620, the thickness of the substrate B is measured. When the coating start potion 801 of the substrate B has reached the position right under the discharge opening 534 of the die 520, the movement of the stage 506 is stopped. At this time, the measured thickness data of the substrate B is used to drive the vertical lift units 570, lowering the die 520 to a first lowering position so that the clearance between the discharge opening face 536 of the die 520 and the substrate B becomes a preset first clearance. Then, the syringe pump 550 is driven to discharge a certain amount of the coating liquid 566 from the discharge opening 534 of the die 520, to form bead.

After lapse of certain time, the die 520 is moved to a second lowering position in the vertical direction so that the clearance between the discharge opening face 536 of the die 520 and the substrate B becomes a second clearance. It is preferred that the second clearance is set to maintain the once formed bead. In this state, the piston 554 of the syringe pump 550 is raised at a predetermined speed to discharge the coating liquid 566 from the die 520, and after the bead have grown to a predetermined size after lapse of a certain time, the movement of the stage 506 is started at a predetermined speed, while the coating of the substrate B with the coating liquid 566 is started to form a coating film on the substrate B.

In this case, the discharge of the coating liquid 566 from the die 520 and the start of relative movement of the stage 506 and the die 520 can occur simultaneously, or the start of relative movement of the stage 506 and the die 520 can occur earlier.

The relation between the time when the piston 554 of the syringe pump 550 reaches a predetermined speed and the time when the stage 506 reaches a predetermined speed can be arbitrary. However, it is preferred that both the times are simultaneous or that the time when the stage 506 reaches a predetermined speed occurs later.

Then, when the coating end portion of the substrate B comes to the position under the discharge opening 534 of the die 520, the piston 554 is stopped, and the feed of the coating liquid 566 is stopped. Subsequently, the so-called squeegee coating state takes place in which the coating liquid remaining between the discharge opening face 536 of the die 520 and the substrate B is partially transferred to the substrate B while the substrate B is moved. Then, the vertical lift units 570 are driven to raise the die 520. As a result, the bead formed between the substrate B and the die 520 are cut off to end the coating.

Also in this duration, the stage 506 continues its action, and when it comes to the end position, it is stopped, while the substrate B is released from suction, the lift pins being raised to lift the substrate B. At this time, an unloader not shown in the drawing is used to hold the bottom face of the substrate B and carries the substrate B to the subsequent process. After the substrate B has been transferred to the unloader, the stage 506 makes the lift pins descend and is returned to its home position. After the stage 506 has been returned to its home position, the wipe-off unit 590 is moved so that the tray 600 comes to the position under the discharge opening 534 of the die 520.

Subsequently, the syringe pump 550 is actuated to feed a small amount (10 μL to 500 μL) of the coating liquid 566 to the die 520, for filling the voids remaining in the die 520 with the coating liquid 566.

After completion of this action, the syringe pump 550 is actuated to fill the syringe 552 with the coating liquid 566. After completion of filling, the piston 554 is stopped and the suction valve 544 is closed while the feed valve 542 is opened, for standing by till the next new substrate B comes. Whenever a new substrate B comes, the same actions are repeated.

In this coating, it is preferred that the first clearance is from 20 μm to 200 μm, and that the second clearance is from 40 μm to 300 μm.

After the first clearance has been set, a certain amount of the coating liquid 566 is discharged from the discharge opening 534 of the die 520. As a result, even if there are slight voids near the discharge opening 534 of the slit 528, (a) the voids are pressed outside the discharge opening 534, and (b) the coating liquid 566 discharged from the discharge opening 534 flows along the clearance formed between the discharge opening face 536 and the substrate B in the longitudinal direction of the die 520 due to a kind of capillary action. Thus, the voids of the slit 528 are pressed out by the coating liquid 566, and even if voids should remain in the clearance between the discharge opening face 536 at and near the discharge opening 534 and the substrate B, they are discharged from the clearance by the coating liquid 566 migrating due to capillary action. As a result, continuous bead of the coating liquid 566 are formed in the longitudinal direction between the discharge opening face 536 and the substrate B. So, it does not happen that voids affect the subsequent coating.

The amount discharged from the discharge opening 534 is explained below in reference to FIG. 17. In FIG. 17, if the length of the discharge opening face 536 of the die 520 in the coating direction (arrow direction) is Ls, the first clearance between the discharge opening face 536 and the substrate B is S2 and the length of the discharge opening 534 in the longitudinal direction is W, then the volume V of the space is expressed by $V=Ls\times S2\times W$. It is preferred that the discharged amount in this case is from 5% to 100% of the volume V. A more preferred range is from 10% to 50%. If the rate to the volume V is $\alpha 2$, the range of rate $\alpha 2$ is expressed as $0.05\leqq\alpha 2\leqq 1.0$.

The discharged amount of the coating liquid 566 specified as above forms the bead 630 based on the continuation of the coating liquid 566 between the discharge opening face 536 and the substrate B. If the discharged amount of the coating liquid 566 is smaller than this range, the velocity at which the coating liquid 566 flows in the longitudinal direction of the die due to capillary action becomes very low, to also retard the tact time of coating. On the other hand, if the amount is larger than this range, the coating liquid 566 flows quickly in the longitudinal direction of the die 520, to greatly decrease the time for discharging the voids. However, on the other hand, the coating liquid 566 is pressed out from the clearance formed between the discharge opening face 536 and the substrate B, and it can happen that subsequent coating cannot be performed normally.

If the first clearance is smaller than the above range, it can happen that the substrate B and the discharge opening face 536 collide with each other due to the thickness irregularity of the substrate B. If the first clearance is larger than said range, the velocity at which the coating liquid 566 migrates along the clearance formed between the substrate B and the discharge opening face 536 due to capillary action becomes very low, and it can happen that the voids cannot be eliminated by the coating liquid 566 within a short time, not allowing the coating liquid 566 to be continuous for forming the bead. Furthermore, if the second clearance is smaller than said range, the shearing force acting on the coating liquid 566 during coating becomes large, and such a defect as non-coated spots may occur during coating. If the second clearance is larger than said range, it can happen that the bead formed by the first clearance are cut off to form non-coated spots 803 free from the coating liquid 566 at the coating start portion 801.

The size of the first clearance can be the same as the size of the second clearance, but it is preferred that the size of the first clearance is smaller than the size of the second clearance.

In the case where the size of the first clearance is smaller than the size of the second clearance, the flow velocity of the coating liquid 566 in the longitudinal direction of the die due to the effect of capillary action on the coating liquid 566 discharged from the discharge opening 534 becomes high. Furthermore, if the size of the second clearance is larger, the upper limit in the discharged amount of the coating liquid allowed for the clearance formed between the discharge opening face 536 and the substrate B becomes larger, to enlarge the operation margin in the control of the film thickness at the coating start portion 801, and the film thickness control at the coating start portion 801 becomes easier.

On the contrary, if the size of the second clearance is smaller, the allowable volume of the bank of the coating liquid 566 formed in the clearance between the discharge opening face 536 and the substrate B becomes small, and inconveniences such that the extra coating liquid 566 pressed out soils the portion not to be coated on the substrate B can occur.

The first clearance is set to discharge a certain amount of the coating liquid 566 from the discharge opening 534, and after lapse of certain standby time, the second clearance can be set. It is preferred that the standby time is from 0.1 second to 10 seconds. A more preferred range is from 0.3 second to 3 seconds. If the standby time is shorter than the range, sufficient time is not available for ensuring that the coating liquid 566 migrates along the clearance formed between the substrate B and the discharge opening face 536 due to capillary action to eliminate the voids for thereby forming the bead based on the continuation of the coating liquid 566. If the time is longer than the range, the tact time becomes very long as a factor to inhibit the enhancement of productivity.

As described above, the first clearance is set to discharge a certain amount of the coating liquid 566, for discharging the voids in the slit 528 outside the discharge opening 534, and the voids remaining outside the die 520 at and near the discharge opening 534 are further discharged by the coating liquid 566 migrating in the longitudinal direction of the die due to the effect of capillary action. So, the bead in which the coating liquid 566 filling the clearance between the discharge opening face 536 and the substrate B continues in the longitudinal direction can be easily formed.

If coating is started in succession with the second clearance ensuring the bead to be maintained, it does not happen that the non-coated spots 803 as shown in FIG. 16A are formed at the coating start portion 801, and the coating liquid 566 can be applied without any coating defect at the coating start portion 801 as shown in FIG. 16B. If the non-coated spots 803 are not formed, the defect of streaks 804 caused from the non-coated spots 803 can be prevented, and furthermore the area of the non-product portion caused by uneven film thickness due to the non-coated spots 803 can be diminished.

This method can be applied irrespectively of the coating liquid used and the coating amount. So, if this method is used, it is not necessary to change the composition or solid content of the coating liquid or to increase the coating amount for avoiding the spots free from coating at the coating start portion. Especially if the coating amount is increased, the coating liquid 566 can flow due to the inclination of the substrate while the coating liquid applied is dried, to impair the film thickness uniformity. This inconvenience can be avoided if the method is used.

Moreover, this method can also be applied to a coater employing the preliminary coating of a roll for avoiding the non-coated spots 803 at the coating start portion 801. In this case, since the preliminary coating of the roll is not required at all, the wasteful consumption of the coating liquid can be avoided, and the tact time can be shortened since the preliminary coating is not necessary.

It is preferred that the viscosity of the coating liquid 566 to which this method can be applied is from 1 mPa·s to 1,000 mPa·s. A more preferred range is from 1 mPa·s to 50 mPa·s. In view of coating property, it is preferred that the coating liquid 566 is Newtonian, but a thixotropic coating liquid can also be used. Especially when a highly volatile solvent such as PGMEA, butyl acetate or ethyl lactate is used in the coating liquid, this method is effective.

Particular examples of the coating liquid 566 to which this method can be applied include a black matrix for a color filter, a coating liquid for forming color pixels, resist liquid, and overcoating material. The member to be coated, as the substrate, can be a glass sheet, metallic sheet such as aluminum sheet, ceramic sheet or silicone wafer, etc.

It is preferred that the coating speed used is from 0.1 m/min to 10 m/min. A more preferred range is from 0.5 m/min to 6 m/min. It is preferred that the gap width of die lip gap is from 50 μm to 1,000 μm. A more preferred range is from 80 μm to 200 μm. It is preferred that the coating thickness in the wet state is from 1 μm to 50 μm. A more preferred range is from 2 μm to 20 μm. Especially in the case where the coating thickness in the wet state is 20 μm or less, the effect of the invention is remarkable.

The invention is further explained in reference to particular examples.

EXAMPLE 1 AND COMPARATIVE EXAMPLES 1 AND 2

On a 360 mm wide, 465 mm long and 0.7 mm thick non-alkali glass substrate, formed was a 1 μm thick black matrix film with a lattice having a diagonal length of 508 mm (20 inches) (305 mm in the transverse direction of the substrate and 406 mm in the longitudinal direction of the substrate) consisting of 20 μm wide lines at a pitch of 254 μm in the transverse direction of the substrate and at a pitch of 85 μm in the longitudinal direction of the substrate and having 4,800 (in the longitudinal direction of the substrate)×1,200 (in the transverse direction of the substrate) RBG pixel regions.

The black matrix film was formed by using a nitride titanate as a light-shielding material and a polyamic acid as a binder.

In succession, the particles on the substrate were removed by wet washing. Then, prepared was a red coating liquid by mixing a polyamic acid as a binder, a mixture consisting of γ-butyrolactone, N-methyl-2-pyrrolidone and 3-methyl-methoxybutanol as a solvent and Pigment Red 177 as a pigment at a solid content of 10%, and adjusting to a viscosity of 50 mPa·s.

The slit die 1 of the invention shown in FIG. 1 (Example 1), the conventional slit die 301 shown in FIG. 12 (Comparative Example 1) or the conventional slit die 401 shown in FIG. 13 (Comparative Example 2) was installed in the die coater 21 shown in FIG. 9, and each glass substrate was coated on the entire surface with the coating liquid prepared as above, under the following conditions.

The substrates coated using the respective slit dies were dried at 100° C. for 20 minutes by a dryer using a hot plate. The thickness accuracy of the coating film on each of the dried substrates was measured over the entire surface of the substrate using an optical interference type non-contact thickness meter. The results of measurement are shown in Table 1. The coating thickness accuracy shown in Table 1 was obtained by dividing the maximum deviation of coating thickness irregularity by the mean value of coating thicknesses, and expressed in percentage (%)

Coating Conditions:

Coating thickness: 20 μm, coating speed: 3 m/min, clearance: 100 μm

The approximate forms, dimensions, accuracy values, etc. of respective parts of the slit die 1 of Example 1 were as follows.

Second Lip 2:

Outside dimensions: 400 mm wide, 75 mm high and 30 mm thick

Length LA of tip 18: 0.5 mm

Flatness of inner face 17*a*: 1.5 μm

Form of manifold 12: 358 mm wide and 4 mm deep T form

Length Ld of lip gap 13 in discharge direction: 30 mm

First Lip 3:

Outside dimensions of first block 4: 400 mm wide, 35 mm high and 30 mm thick Outside dimensions of second block 5: 400 mm wide, 40 mm high and 30 mm thick Flatness of inner face 15*a* of first block 4: 1.4 μm Flatness of inner face 15*b* of second block 5: 1.5 μm Outside dimensions of stepped blocks 10: 26 mm wide, 26 mm high and 14 mm thick Number and installation intervals of stepped blocks 10: Eight and 27 mm Surface roughness of step faces 10*a* and 10*b* of stepped blocks 10: 0.5 S Length LB of tip 19: 0.05 mm For the position difference H of the first lip 3, the respective position difference distances h of the eight stepped blocks 10 were finely changed by means of lapping, for fine adjustment till the maximum deviation of the position difference distance H in the longitudinal direction became 0.2 μm within the range of coating width. The mean position difference distance H was 101.5 μm. When the second lip 2 and the first lip 3 were combined, two 101.3 μm thick stainless steel sealing plates 6*a* and 6*b* were made to intervene with the interval Lw between them kept at 358 mm as discharge width. Thus, a lip gap 13 with a gap width Lg of 101.5 μm was formed. The lip gap accuracy in this case was 0.4 μm.

In each of the conventional slit dies of Comparative Examples 1 and 2, the discharge width, the forms of the lip tips, the form of the manifold, the length of the lip gap in the discharge direction were set at the same values as in the slit die of Example 1. The forms, dimensions and accuracy values of the other parts were as follows.

COMPARATIVE EXAMPLE 1

Outside dimensions of right lip 302 and left lip 303: 400 mm wide, 75 mm high and 30 mm thick Flatness of inner face of right lip 302: 1.3 μm Flatness of inner face of left lip 303: 1.4 μm Thickness of shim 304 (size L of lip gap 312): 101 μm Lip gap accuracy: 2.8 μm

COMPARATIVE EXAMPLE 2

Outside dimensions of right lip 402 and left lip 403: 400 mm wide, 75 mm high and 30 mm thick Position difference distance (size L of lip gap 412) of right lip 402: 103.3 μm Deviation of position difference distance of right lip 402: 1.2 μm Flatness of inner face of left lip 403: 1.3 μm Lip gap accuracy: 1.4 μm

TABLE 1

| | Example 1 | Comparative Example 1 | Comparative Example 2 |
|---|---|---|---|
| Lip gap accuracy (μm) | 0.4 | 2.8 | 1.4 |
| Coating thickness accuracy (%) | 1.0-2.5 | 6.0-7.0 | 4.0-5.0 |

From Table 1, it can be seen that in the slit die of the invention (Example 1), a lip gap accuracy in the order of sub-microns is achieved. Furthermore, it can be seen that the thickness accuracy of the coating film is remarkably high compared with those in Comparative Examples 1 and 2.

Then, on the dried red coating film, a resist liquid with a solid content of 10% and a viscosity of 8 mPa·s was applied, to form a 10 μm thick layer. After completion of coating, it was dried by a 90° C. hot plate for 10 minutes. After completion of drying, exposure, development and stripping were performed to leave the color coating film only in the red pixel regions, and a 260° C. hot plate was used for heating for 30 minutes, to achieve is curing.

Also for green and blue colors, color coating films were formed using the slit die and the die coater of Example 1 under the same coating conditions using the same process as those of red color.

As the green coating liquid, a liquid containing Pigment Green 36 instead of the pigment of the red coating liquid and prepared to have a solid content of 10% and a viscosity of 40 mPa·s was used. As the blue coating liquid, a liquid containing Pigment Blue 15 instead of the pigment of the red coating liquid and prepared to have a solid content of 10% and a viscosity of 50 mPa·s was used.

Finally, ITO was deposited by sputtering, to produce a color filter. The obtained color filter had very uniform chromaticity over the entire surface of the substrate and was satisfactory in quality.

EXAMPLE 2 AND COMPARATIVE EXAMPLES 3 AND 4

A 340 mm wide, 440 mm long and 2.8 mm thick soda glass substrate was coated on its entire surface with a photosensitive sliver paste to have a thickness of 5 μm by screen printing. Subsequently, it was exposed using a photo mask, developed and baked to form a silver electrode with 1,920 stripes at a pitch of 220 μm. On the electrode, a glass paste consisting of glass and a binder was applied by screen printing. Then, the substrate was baked to form a dielectric layer.

Then, the slit die 101 (Example 2) shown in FIG. 4, the conventional slit die 201 shown in FIG. 11 (Comparative Example 3) or the conventional slit die 301 shown in FIG. 12 (Comparative Example 4) was installed in the die coater 21 shown in FIG. 9.

The die coater 21 was used to coat the substrate with a photosensitive glass paste composed of a glass powder and a photosensitive organic ingredient and having a viscosity of 20,000 mPa·s to have a coating thickness of 300 μm at a coasting speed of 1 m/min at a clearance of 350 μm. After completion of coating, the substrate was transferred by a transfer machine from the die coater 21 into a drying oven using a radiation heater, for being dried at 100° C. for 20 minutes. After completion of drying, the thickness accuracy of the coating film formed on the substrate was measured over the entire surface of the substrate using a laser focus non-contact film thickness meter. The results of measurement are shown in Table 2. The coating thickness accuracy shown in Table 2 was obtained by dividing the maximum deviation of coating thickness irregularity by the mean value of coating thicknesses, and expressed in percentage (%).

The approximate forms, dimensions, accuracy values, etc. of the slit die 101 of Example 2 were as follows.

Second Lip 2:

Outside dimensions: 470 mm wide, 100 mm high and 50 mm thick

Length LA of tip 18: 2.5 mm

Flatness of inner face 17*a:* 1.3 μm

Form of manifold 12: 450 mm wide and 20 mm deep T form

Length Ld of lip gap 13 in discharge direction: 20 mm

First Lip 3:

Outside dimensions of first block 4: 490 mm wide, 100 mm high and 50 mm thick Outside dimensions of second block 5: 490 wide, 100 mm high and 50 mm thick Flatness of inner face 15*a* of first block 4: 2.3 μm Flatness of inner face 15*b* of second block 5: 1.5 μm Outside dimensions of flat blocks 110: 40 mm wide, 35 mm high and 18 mm thick Surface roughness of flat blocks 110: 0.8 S Number and installation intervals of flat blocks 110: Five and 70 mm Size of shims 114: 40 mm wide and 15 mm high Thicknesses of respective shims 114: 501.0 μm to 501.8 μm Length LB of tip 19: 1.0 mm The position difference of the first lip 3 was finely adjusted by slightly changing the respective thicknesses of five shims 114 by lapping, till the maximum deviation of position difference distance H in the longitudinal direction became 0.4 μm within the range of coating width. The mean position difference distance H was 501.2 μm. When the second lip 2 and the first lip 3 were combined, two 501.3 μm thick stainless steel sealing plates 6*a* and 6*b* were made to intervene with the interval Lw between them kept at 430 mm as discharge width. Thus, a lip gap 13 with a gap width Lg of 501.6 μm was formed. The lip gap accuracy in this case was 0.5 μm.

In each of the conventional slit dies of Comparative Examples 3 and 4, the discharge width, the forms of the lip tips, the form of the manifold and the length of, the lip gap in the discharge direction were set at the same values as in the slit die of Example 2. The forms, dimensions and accuracies of the other parts were as follows.

COMPARATIVE EXAMPLE 3

Outside dimensions of right lip 202 and left lip 203: 490 mm wide, 100 mm high and 50 mm thick Flatness of inner face of right lip 202: 1.7 μm Flatness of inner face of left lip 203: 2.2 μm Mean value of inter-lip gap L (size L of lip gap 212): 503.4

Lip gap accuracy: 8.3 μm

COMPARATIVE EXAMPLE 4

Outside dimensions of right lip 302 and left lip 303: 490 mm wide, 100 mm high and 50 mm thick Flatness of inner face of right lip 302: 1.8 μm Flatness of inner face of left lip 303: 1.4 μm Thickness of shim 304 (size L of lip gap 312): 498 μm Lip gap accuracy: 5.0 μm

TABLE 2

| | Example 2 | Comparative Example 3 | Comparative Example 4 |
|---|---|---|---|
| Lip gap accuracy (μm) | 0.5 | 8.3 | 5.0 |
| Coating thickness accuracy (%) | 0.5-1.0 | 7.0-8.0 | 4.0-5.0 |

From Table 2, it can be seen that also in the slit die of the invention (Example 2), a lip gap accuracy in the order of sub-microns is realized. Furthermore, it can be seen that the thickness accuracy of the coating film is remarkably higher than those of Comparative Examples 3 and 4.

A substrate coated with a coating liquid using the slit die of the invention (Example 2) was exposed using a photo mask designed to form each partition wall between respectively adjacent electrodes, and developed and baked, to form 30 μm wide and 130 μm high 1,921 partition walls at a pitch of 220 μm in respective regions.

Then, red, green and blue fluorescent pastes were applied one after another by screen printing and dried at 80° C. for 15 minutes, finally being baked at 460° C. for 15 minutes, to produce a back plate of a plasma display. The quality of the obtained back plate of a plasma display was satisfactory. Subsequently, this back plate of a plasma display and a front plate were joined and hermetically sealed, to contain a mixed gas consisting of 5% Xe and 95% Ne, and a drive circuit was connected. The obtained plasma display was driven, and it was found to be a plasma display with good picture quality free from any defect.

EXAMPLE 3

The die coater 501 shown in FIG. 14 was used to produce a color filter. In the die 520, the length of the discharge opening 534 in the longitudinal direction was 360 mm, and the length of the discharge opening face 536 in the coating direction was 0.5 mm, the gap width of the slit 528 being 100 μm. The die 520 could be used to form a 360 mm wide coating film on the substrate B.

At first, a 360 mm wide, 465 mm long and 0.7 mm thick non-alkali glass substrate was washed. After completion of washing, a coating liquid for a black matrix was applied to the substrate B at a coating speed of 3 m/min with the clearance between the die 520 and the substrate B kept at 100 μm.

For the coating, the area at and near the discharge opening 534 of the die 520 was wiped using a silicone rubber with the same form as that of the discharge opening, and the die 520 was brought closer to the substrate B to have a clearance of 100 μm at the coating start portion of the stationary substrate B. Furthermore, for the coating, the coating liquid 566 to be applied for having a wet thickness of 10 μm was fed from the syringe pump 550, and the movement of the substrate B was started 0.5 second after start of the liquid feed by the pump.

The coating liquid used for forming a black matrix consisted of a nitride titanate as a light shielding material, an acrylic resin as a binder and PGMEA as a solvent and had a solid content of 10% and a viscosity of 10 mPa·s, being photosensitive.

Since the thickness of the coating film to be formed was small, five non-coated spots were formed in the width direction of the substrate at the coating start portion. To avoid the defect, the area at and near the discharge opening 534 of the die 520 was wiped using a silicone rubber with the same form as that of the discharge opening, and the die 520 was brought closer to the substrate B to have a clearance of 50 μm at the coating start portion of the stationary substrate B. The coating liquid for a black matrix was discharged by 5 μL, being followed by a standby of 3 seconds.

Then, the clearance between the die 520 and the substrate B was set at 100 μm, being followed by a stand by of 0.1 second. After completion of standby, such an amount of the coating liquid 566 as to allow coating to form a wet thickness of 10 μm was fed from the syringe pump 550, and the movement of the substrate B was started 0.2 second after start of liquid feed by the pump. As a result, the non-coated spots at the coating start portion could be completely avoided. The tact time of coating was 30 seconds.

The substrate with the coating film formed was dried using a 100° C. hot plate for 10 minutes. After completion of drying, the substrate was treated for exposure, development and stripping. Then, it was heated using a 260° C. hot plate 30 minutes, for curing.

The obtained substrate had a 1 μm thick black matrix film with a lattice having a diagonal length of 508 mm (20 inches) (305 mm in the transverse direction of the substrate and 406 mm in the longitudinal direction of the substrate) consisting of 20 μm wide lines at a pitch of 254 μm in the transverse direction of the substrate and at a pitch of 85 μm in the longitudinal direction of the substrate and having 4,800 (in the longitudinal direction of the substrate)×1,200 (in the transverse direction of the substrate) RBG pixel regions. The coating thickness was measured after drying before forming the lattice pattern, and excluding 10 mm areas at the ends, the thickness irregularity was not larger than ±3% of the median in either the traveling direction or the transverse direction of the substrate.

The substrate having the black matrix film formed was wet-washed and coated with a red coating liquid to have a coating thickness of 20μ at a coating speed of 3 m/min with the clearance between the die 520 and the substrate B kept at 100 μm.

The red coating liquid was obtained by mixing an acrylic resin as a binder, PGMEA as a solvent and Pigment Red 177 as a pigment to have a solid content of 10% and had a viscosity of 5 mPa·s, being photosensitive.

The coated substrate was dried using a 90° C. hot plate for 10 minutes and treated for exposure, development and stripping, to leave a 2 μm thick red coating film in the red pixel regions only. It was heated using a 260° C. hot plate for 30 minutes, for curing.

In succession, the substrate having the black matrix and the red coating film formed was coated with a green coating liquid to have a thickness of 20 μm at a coating speed of 3 m/min with the clearance between the die 520 and the substrate B kept at 100 μm. After completion of coating, the substrate was dried using a 100° C. hot plate for 10 minutes and treated for exposure, development and stripping, to leave a 2 μm thick green coating film in the green pixel regions only. It was heated using a 260° C. hot plate for 30 minutes, for curing.

Moreover, the substrate having the black matrix, red coating film and green coating film formed was coated with a blue coating liquid to have a coating thickness of 20 μm at a coating speed of 3 m/min with the clearance between the die 520 and the substrate B kept at 100 μm. After completion of coating, the substrate was dried using a 100° C. hot plate for 10 minutes and treated for exposure, development and stripping, to leave a 2 μm thick blue coating film in the blue pixel regions only. It was heated using a 260° C. hot plate for 30 minutes, for curing.

Meanwhile, the green coating liquid was prepared using Pigment Green 36 instead of the pigment of the red coating liquid, to have a solid content of 10% and a viscosity of 10 mPa·s. Furthermore, the blue coating liquid was prepared using Pigment Blue 15 instead of the pigment of the red coating liquid, to have a solid content of 10% and a viscosity of 10 mPa·s.

For applying each of the red, green and blue coating liquids, the area at and near the discharge opening 534 of the die 520 was wiped using a silicone rubber, and the die 520 was brought closer to the substrate B to have a clearance of 100 μm at the coating start portion of the stationary substrate B, and such an amount of the coating liquid as corresponding to a wet thickness of 20 μm was fed from the syringe pump 550, and the movement of the substrate B was started 0.3 second after start of liquid feed by the pump. The tact time of coating was 30 seconds.

The quality of the coating films of the obtained substrate was satisfactory. Also with regard to the thickness distributions of the coating films, those of the respective colors were measured after drying. Excluding the 10 mm areas at the ends, the thickness irregularity was not larger than ±3% of the median in either the traveling direction or the transverse direction of the substrate.

Finally, ITO was deposited on the obtained substrate by sputtering. This production method was used to produce 1,000 color filters. The obtained color filters were free from coating irregularity, and the chromaticity of the respective color filters was uniform over the entire surface of each substrate. The respective color filters were satisfactory in quality.

INDUSTRIAL APPLICABILITY

According to the invention, in the production of a substrate with coating films, since the wasteful consumption of the expensive coating liquids can be greatly decreased, the production cost can be reduced. Furthermore, larger substrates are being increasingly employed, and since they can be uniformly coated with coating liquids, the economic efficiency of production can be enhanced. Also since the tact time can be shortened, the productivity can be enhanced.

While the advantage of die coaters was not sufficiently exhibited in the past, the invention induces the advantage of die coaters sufficiently. The invention provides a slit die used for producing a substrate with coating films having very high quality and having stable film thickness accuracy, without impairing the advantage of the die coater attributable to its excellent capability to hermetically contain the coating liquids. The invention also provides a method and apparatus for producing a substrate with coating films using said slit die.

The invention is especially suitable for forming coating films on the unit sheets fed one by one and can be preferably used for producing display members such as color filters for color liquid crystal displays, array substrates for TFT, back plates and front plates for plasma displays, optical filters and printed boards, and also other coated unit sheets such as integrated circuits and semiconductors.

The invention claimed is:

1. A slit die, comprising a first lip and a second lip, wherein said first lip and said second lip are integrated by a lip fastening element in a state that an inner face of said first lip and an inner face of said second lip are faced each other; partial portions of the inner faces facing each other are positioned with a gap to form a liquid feed passage and a lip gap extending in the longitudinal direction of said lips; the lower end of said lip gap forms a discharge opening toward outside; both the ends in the longitudinal direction of said lip gap are closed from outside; and the top end of said lip gap communicates with said liquid feed passage, wherein (a) said first lip comprises a first block and a second block, (b) a block engaging element is provided for keeping said first block and said second block engaged with each other in such a manner that the relative position between said first block and said second block can be adjusted in the direction perpendicular to the face forming said lip gap, of said first lip, (c) a block fastening element is provided for fastening and integrating said first block and said second block after said relative position has been adjusted, (d) at least one positioning element is provided to decide said relative position between said first block and said second block, wherein said positioning element comprises a positioning block having a position deciding face which is kept in contact with the outer face of said first block on the side opposite to said inner face of said first lip and/or the outer face of said second block on the side opposite to said inner face of said first lip, and wherein in the case where there is a gap between said positioning block and the outer face of said first block or the outer face of said second block, a positioning decision assisting means is provided between said positioning block and the outer face of said first block or the outer face of said second block through said gap, (e) a positioning element fixing element is provided for fixing said positioning element to said first lip, and (f) said positioning element and said positioning element fixing element allow the gap width distribution of said lip gap in the longitudinal direction to be adjusted.

2. A slit die, according to claim 1, wherein a plurality of positioning elements is provided at plural positions with an interval kept between them in the longitudinal direction of said lips.

3. A slit die, according to claim 1, wherein the maximum height Ry of the surface roughness of said position deciding face of said positioning block is from 0.1S to 1.0S.

4. A slit die, according to claim 3, wherein the thicknesses of said first block and said second block in the direction perpendicular to the face forming said lip gap are respectively 30 mm or more; a sectional form of said positioning block in the direction along said position deciding face is quadrangular; the length of said quadrangle in the longitudinal direction of said lips is from 20 mm to 100 mm, while the length in the direction perpendicular to the longitudinal direction is from 20 mm to 100 mm; and the thickness of said positioning block at the region where at least said position deciding face is positioned is 30% or more of the thickness of said second block.

5. A slit die, according to claim 4, wherein a plurality of positioning blocks is provided at plural positions with an interval kept between them in the longitudinal direction of said lips.

6. A slit die, according to claim 1, wherein said second lip has a structure similar to that of said first lip.

7. A slit die, according to claim 1, wherein the inner face of said first block and the inner face of said second lip are positioned in contact with each other or through a shim, and that said lip gap is formed between the inner face of said second block and the inner face of said second lip.

8. A slit die, according to claim 7, wherein the inner face of said second lip facing the inner face of said first block and the inner face of said second lip forming said lip gap are positioned substantially in the same plane.

9. A slit die, according to claim 7, wherein the inner face of said first block facing the inner face of said second lip and the inner face of said second block forming said lip gap are positioned substantially in the same plane.

10. A method for producing a substrate with coating films by using a slit die as set forth in claim 1, comprising the steps of feeding a coating liquid into said liquid feed passage of said slit die, discharging said coating liquid from said discharge opening through said lip gap, relatively moving at least either a member to be coated, positioned with a clearance formed against said discharge opening or said slit die, coating said member to be coated, with said coating liquid discharged from said discharge opening, for forming a coating film of said coating liquid on said member to be coated.

11. A method for producing a substrate with coating films, according to claim 10, which comprises a first step of discharging said coating liquid with a certain volume Q1 from said discharge opening of said slit die, a second step of standing by for a certain time period Ts after completion of the first step, a third step of moving said discharge opening relatively to said member to be coated, after completion of the second step, for forming a clearance S1 between them, and a fourth step of discharging said coating liquid from said discharge opening after completion of the third step, while moving said member to be coated, relatively to said slit die, for forming a coating film on said member to be coated.

12. A method for producing a substrate with coating films, according to claim 11, wherein said certain volume Q1 satisfies the relation of $Q1=\alpha 1\times S1\times Ls\times W$, where Ls is the length of the face including said discharge opening in the coating direction; W is the length of said discharge opening in the longitudinal direction, S1 is said clearance and $\alpha 1$ is a coefficient in a range of $0.05\leqq\alpha 1\leqq 1.0$.

13. A method for producing a substrate with coating films, according to claim 10, which comprises a first step of moving said discharge opening of said slit die relatively to said member to be coated, kept stationary, for forming a clearance S2 between them, a second step of discharging said coating liquid with a certain volume Q2 from said discharge opening after completion of the first step, a third step of standing by for a certain time period Ts after completion of the second step, and a fourth step of discharging said coating liquid from said discharge opening, after completion of the third step, while moving said member to be coated, relatively to said slit die, for forming a coating film on said member to be coated.

14. A method for producing a substrate with coating films, according to claim 10, which comprises a first step of moving said discharge opening of said slit die relatively to said member to be coated, kept stationary, for forming a first clearance S3 between them, a second step of discharging said coating liquid with a certain volume Q from said discharge opening after completion of the first step, a third step of standing by for a certain time period Ts after completion of the second step, a fourth step of re-moving said discharge opening of said slit die relatively to said member to be coated, kept stationary, after completion of the third step, for forming a second clearance S4 between them, and a fifth step of discharging said coating liquid from said discharge opening, after completion of the fourth step, while moving said member to be coated, relatively to said slit die, for forming a coating film on said member to be coated.

15. A method for producing a substrate with coating films, according to claim 14, wherein the size of said first clearance S3 is smaller than the size of said second clearance S4.

16. A method for producing a substrate with coating films, according to claim 13, wherein said certain volume Q2 satisfies the relation of $Q2=\alpha 2\times S2\times Ls\times W$, where Ls is the length of the face including said discharge opening in the coating direction, W is the length of said discharge opening in the longitudinal direction, S2 is said clearance and $\alpha$2 is a coefficient in a range from $0.05 \leqq \alpha 2 \leqq 1.0$.

17. An apparatus for producing a substrate with coating films, comprising the slit die as set forth in claim 1, a coating liquid feed means engaged with said liquid feed passage of said slit die, a coating liquid discharge means for discharging a coating liquid fed into said liquid feed passage, from said discharge opening through said slit gap, and a coating film forming means for relatively moving at least either a member to be coated, positioned with a clearance formed against said discharge opening, or said slit die, to coat said member to be coated, with said coating liquid discharged from said discharge opening, for forming a coating film of said coating liquid on said member to be coated.

18. An apparatus for producing a substrate with coating films, according to claim 17, wherein said coating liquid discharge means includes a means for discharging a certain amount of said coating liquid from said discharge opening of said slit die, and further comprises a means for letting a certain standby time period to elapse after discharging said certain amount of said coating liquid, and said coating film forming means includes a means for relatively moving at least either a member to be coated, positioned with a clearance formed against said discharge opening, or said slit die after lapse of said standby time period.

19. A slit die according to claim 1, wherein said block engaging element and said block fastening element are one and the same element.

20. A slit die according to claim 1, wherein at least one of said block engaging element and said block fastening element comprises a bolt.

21. A slit die according to claim 1, wherein at least one of said block engaging element and said block fastening element comprises threads.

22. A slit die according to claim 21, wherein the threads are provided in a nut.

* * * * *

UNITED STATES PATENT AND TRADEMARK OFFICE

CERTIFICATE OF CORRECTION

PATENT NO. : 7,622,004 B2
APPLICATION NO. : 10/547534
DATED : November 24, 2009
INVENTOR(S) : Kawatake et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1092 days.

Signed and Sealed this

Twenty-sixth Day of October, 2010

David J. Kappos

David J. Kappos
*Director of the United States Patent and Trademark Office*